US007482976B2

(12) United States Patent
Plesinger

(10) Patent No.: US 7,482,976 B2
(45) Date of Patent: Jan. 27, 2009

(54) ANTENNA CALIBRATION METHOD AND APPARATUS

(75) Inventor: Gregory H. Plesinger, Cave Creek, AZ (US)

(73) Assignee: Aviation Communication & Surveillance Systems, Phoenix, AZ (US)

( * ) Notice: Subject to any disclaimer, the term of this patent is extended or adjusted under 35 U.S.C. 154(b) by 0 days.

(21) Appl. No.: 11/697,757

(22) Filed: Apr. 9, 2007

(65) Prior Publication Data

US 2007/0247363 A1 Oct. 25, 2007

Related U.S. Application Data

(60) Provisional application No. 60/790,925, filed on Apr. 10, 2006.

(51) Int. Cl.
*H01Q 3/00* (2006.01)

(52) U.S. Cl. ..... 342/372; 342/368

(58) Field of Classification Search ..... 342/368, 342/372

See application file for complete search history.

(56) References Cited

U.S. PATENT DOCUMENTS 4,348,676 A 9/1982 Tom
4,855,748 A 8/1989 Brandao et al.
5,008,844 A 4/1991 Kyriakos et al.
5,038,146 A 8/1991 Troychak et al.
5,086,302 A * 2/1992 Miller ..... 342/373
5,412,414 A 5/1995 Ast et al.
5,469,172 A 11/1995 Schleder et al.
5,530,449 A 6/1996 Wachs et al.
5,604,504 A 2/1997 Nail
5,805,111 A 9/1998 Brettner, III et al.
5,923,293 A 7/1999 Smith et al.
6,133,868 A 10/2000 Butler et al.
6,157,343 A * 12/2000 Andersson et al. ..... 342/371
6,169,519 B1 1/2001 Holecek et al.
6,185,440 B1 2/2001 Barratt et al.
6,285,313 B1 9/2001 Wahab et al.
6,313,783 B1 11/2001 Kuntman et al.
6,339,399 B1 1/2002 Andersson et al.
6,392,598 B1 5/2002 Jones et al.

(Continued)

OTHER PUBLICATIONS

Search Report and Written Opinion; International Patent Application No. PCT/US2007/066288; Apr. 18, 2008.

*Primary Examiner*—Thomas H Tarcza
*Assistant Examiner*—Nga X Nguyen
(74) *Attorney, Agent, or Firm*—Charles L. Warner, II; Powell Goldstein LLP

(57) ABSTRACT

Measurements of frequency and/or phase are taken at the signal ports (S1-S4) of an ISS device (10). These measurements are used to determine phase errors within the ISS device, and phase errors due to the antenna cables (C1-C4). On port, (e.g., S1) is selected as the reference port and then, based on these determined phase errors, offsetting phase errors are determined to correct the phase for the other ports (e.g., S2, S3, S4) with respect to the reference port. The signals at the antenna ports (A1-A4) are then in phase when an omnidirectional antenna pattern is desired from the TCAS antenna array (16). One in embodiment the frequency of the calibration signal is fixed; in another embodiment two different, fixed frequencies are used; and in still another embodiment the frequency is swept to achieve a predetermined measured phase difference.

8 Claims, 13 Drawing Sheets

U.S. PATENT DOCUMENTS

| | | | | |
|---|---|---|---|---|
| 6,400,318 | B1 | 6/2002 | Kasami et al. | |
| 6,448,938 | B1 | 9/2002 | Chiang et al. | |
| 6,587,069 | B2 | 7/2003 | Ringwald et al. | |
| 6,665,545 | B1 | 12/2003 | Raleigh et al. | |
| 6,975,268 | B2 | 12/2005 | Coleman et al. | |
| 7,006,032 | B2 | 2/2006 | King et al. | |
| 2002/0089447 | A1 * | 7/2002 | Li | 342/174 |
| 2003/0080900 | A1 * | 5/2003 | Schumacher | 342/368 |

* cited by examiner

ANTENNA CALIBRATION METHOD AND APPARATUS

CROSS-REFERENCE TO RELATED APPLICATIONS

This application claims priority to, and the benefit of, U.S. Provisional Patent Application Ser. No. 60/790,925 filed Apr. 10, 2006, entitled "TCAS ANTENNA CABLE CALIBRATION", which is incorporated herein by reference in its entirety.

BACKGROUND OF THE INVENTION

Field of the Invention

The present invention relates to antenna calibration procedures and, more particularly, to antenna calibration procedures for remote antennas and, even more particularly, to antenna systems which are used for both Traffic Collision Avoidance System (TCAS) and air traffic control mode S (Mode S). In one TCAS/Mode S implementation, the TCAS uses a directional antenna and Mode S uses an omnidirectional antenna.

In the new Integrated Surveillance System (ISS), however, the TCAS and Mode S functions are combined in the same device and both functions are to use the same, directional TCAS antenna. As the separate omnidirectional antenna is no longer available for Mode S operations, the TCAS antenna must be driven so that it forms an omnidirectional antenna pattern.

The typical TCAS antenna consists of 4 antennas, evenly spaced (90 degrees) about an axis and spaced the same distance radially from that axis. Each antenna is connected to a separate antenna port, and each antenna typically has an approximately 90 degree beamwidth. A 90 degree width beam can thus be formed at 0, 90, 180, or 270 degrees by driving the appropriate port. It is well known that if all 4 ports of such a TCAS antenna are driven at equal amplitude and phase then the desired omnidirectional antenna pattern is obtained.

The TCAS antenna array is connected to the ISS device by four long cables which traverse the aircraft from the point in the equipment rack where the ISS device is located to the point on the aircraft where the antenna array is located. The problem is that the lengths of these cables are not precisely calibrated. Typically, the difference in length between any of the antenna cables is 1 foot or less. At the frequency of interest, however, i.e., 1090 MHz, and with a cable propagation velocity V=0.7 c, where "c" is the speed of light in a vacuum, one wavelength is only approximately 8 inches, so a 1 inch difference in cable lengths represents an approximately 45 degree phase difference, and a possible one foot difference in cable length represents a phase difference of approximately 540 degrees. These uncontrolled phase differences are greatly in excess of the phase difference which can be tolerated when attempting to provide an omnidirectional antenna pattern using the TCAS antenna.

If a cable is replaced due to damage, its length and phase delay characteristics may be different from the original cables. In addition, time, temperature, and environmental conditions, including the bundling and location of the cables, may affect the characteristics of one cable more or less than other cables. The phase shifts of the four long antenna cables between the ISS device and the antenna are thus not initially calibrated and, even if initially calibrated, may change over time.

The various components within the ISS device itself, even if initially calibrated, may eventually have different phase shifts, especially as they age or a component is replaced. Thus, even the outputs of the ISS device may not be exactly in phase.

These independent, unknown, and uncontrolled phase shifts can seriously degrade the desired omnidirectional pattern and adversely affect the functioning of the ISS device including, but not limited to, the Mode S functions.

BRIEF SUMMARY OF THE INVENTION

Methods are described herein whereby the phase shifts of the antenna cables and/or the phase shifts of the ISS system components can be readily determined and compensated for, so that the TCAS antenna array may be used as an omnidirectional antenna. In addition, a self-calibrating transmitting system is disclosed. The methods described here can be implemented manually or automatically, even if the aircraft is in motion.

One method is for use with a system comprising a phase offset device and providing a plurality of phase-shifted signals to a corresponding plurality of system ports, and provides for determining phase offsets necessary for a phase offset device to compensate for differences in the system components up to approximately the system ports. The method includes providing predetermined phase offsets for at least predetermined system ports to the phase offset device, driving each of the system ports with a signal, adjusting the provided phase offset for each predetermined system port until a predetermined phase condition is detected for the predetermined system port with respect to a first system port, and reducing the provided phase offset for a predetermined system port by the predetermined phase condition for that predetermined system port to determine the compensating phase offset for that predetermined system port with respect to the first system port.

In one embodiment, adjusting the provided phase offset includes monitoring the phase differences between the signal at a first system port and the signals at the other system ports, determining a preliminary phase offset for a second system port with respect to the first system port by adjusting the provided phase offset for the second system port until a predetermined phase condition is detected for the second system port with respect to the first system port, determining a preliminary phase offset for a third system port with respect to the first system port by adjusting the provided phase offset for the third system port until a predetermined phase condition is detected for the third system port with respect to the first system port, and determining a preliminary phase offset for a fourth system port with respect to the first system port by adjusting the provided phase offset for the fourth system port until a predetermined phase condition is detected for the fourth system port with respect to the first system port.

In one embodiment reducing the provided phase offset includes determining a compensating phase offset for the second system port with respect to the first system port by reducing the preliminary phase offset by a predetermined amount, determining a compensating phase offset for the third system port with respect to the first system port by reducing the preliminary phase offset by a predetermined amount, and determining a compensating phase offset for the fourth system port with respect to the first system port by reducing the preliminary phase offset by a predetermined amount.

A transmitter system with automatic compensation for certain phase differences in the system is provided and includes an antenna array having a plurality of antennas in a symmetrical arrangement about an axis, a plurality of system ports connected to the plurality of antennas by a corresponding plurality of antenna cables, a corresponding plurality of transmitters to provide output signals to the plurality of system ports, a phase offset device to provide a corresponding plurality of phase-shifted signals to the plurality of transmitters, a plurality of phase detectors, each phase detector being connected between two system ports to measure the phase difference between the two system ports, each system port being connected to at least three phase detectors, and a processor (1) to control the phase shifts provided by the phase offset device, (2) to activate the plurality of transmitters, (3) to receive the measured phase differences from the plurality of phase detectors, (4) to determine compensating phase offsets based upon the measured phase differences to compensate for the phase differences in system components through the system ports, and (5) to provide an omnidirectional antenna pattern from the antenna array by providing the compensating phase offsets to the phase offset device and activating the plurality of transmitters.

In one embodiment the processor determines the compensating phase offsets by (a) providing phase offsets for at least predetermined system ports to the phase offset device, (b) adjusting the provided phase offset for each predetermined system port until a predetermined phase condition is detected for the predetermined system port with respect to a first system port, (c) determining the compensating phase offset for each predetermined system port with respect to the first system port by reducing the provided phase offset for that predetermined system port by the predetermined phase condition for that predetermined system port.

Another method is for use with a system having an antenna array having a plurality of antennas in a symmetrical arrangement about an axis, a plurality of system ports connected to the plurality of antennas by a corresponding plurality of antenna cables, and a corresponding plurality of transmitters to provide output signals to the plurality of system ports, and provides for determining phase offsets necessary to compensate for differences in the antenna cables. The method includes causing each transmitter of predetermined ones of the plurality of transmitters to drive its corresponding system port with an output signal, the other system ports not being driven, measuring the phase differences between the output signal at the predetermined, driven system port and return signals at predetermined, non-driven system ports, and determining differential phase offsets to compensate for the differences in antenna cables based upon the measured phase differences.

In one embodiment causing each transmitter of predetermined ones of the plurality of transmitters to drive its corresponding system port with an output signal includes selecting and driving a first system port with an output signal, the second, third and fourth system ports not being driven, selecting and driving the second system port with an output signal having a selectable frequency, the other system ports not being driven, and selecting and driving the third system port with an output signal having a selectable frequency, the other system ports not being driven.

A transmitter system with automatic compensation for certain phase differences in the system is provided. The transmitter system includes an antenna array having a plurality of antennas in a symmetrical arrangement about an axis, a plurality of system ports connected to the plurality of antennas by a corresponding plurality of antenna cables, a corresponding plurality of transmitters to provide output signals to the plurality of system ports, a phase offset device to provide a corresponding plurality of phase-shifted signals to the plurality of transmitters, a plurality of phase detectors, each phase detector being connected between two system ports to measure the phase difference between the two system ports, each system port being connected to at least three phase detectors, and a processor (1) to control the phase shifts provided by the phase offset device, (2) to activate predetermined ones of the plurality of transmitters, (3) to receive the measured phase differences from the plurality of phase detectors, (4) to determine differential phase offsets based upon the measured phase differences to compensate for the differences in antenna cables, and (5) to provide an omnidirectional antenna pattern from the antenna array by providing the differential phase offsets to the phase offset device and activating the plurality of transmitters.

In one embodiment the processor determines the differential phase offsets by causing each transmitter of predetermined ones of the plurality of transmitters to drive its corresponding system port with an output signal, the other system ports not being driven, and measuring the phase differences between the output signal at the predetermined, driven system port and return signals at predetermined, non-driven system ports.

Another method is also for use with a system having an antenna array having a plurality of antennas in a symmetrical arrangement about an axis, a plurality of system ports connected to the plurality of antennas by a corresponding plurality of antenna cables, and a corresponding plurality of transmitters to provide output signals to the plurality of system ports, and provides for determining phase offsets necessary to compensate for differences in the antenna cables. The method includes causing each transmitter of predetermined ones of the plurality of transmitters to drive its corresponding system port with an output signal having a first frequency, the other system ports not being driven, measuring the phase differences between the output signal at the predetermined, driven system port and return signals at predetermined, non-driven system ports, causing each transmitter of predetermined ones of the plurality of transmitters to drive its corresponding system port with an output signal having a second frequency, the second frequency being different than the first frequency, the other system ports not being driven, measuring the phase differences between the output signal at the predetermined, driven system port and return signals at predetermined, non-driven system ports, and determining the differential phase offsets to compensate for the differences in antenna cables based upon the measured phase differences.

In one embodiment causing each transmitter of predetermined ones of the plurality of transmitters to drive its corresponding system port includes selecting and driving a first system port with an output signal having a first frequency, the other system ports not being driven, driving the first, driven system port with an output signal having a second frequency, the other system ports not being driven, the second frequency being different from the first frequency, selecting and driving the second system port with an output signal having a first frequency, the other system ports not being driven, selecting and driving the second system port with an output signal having a second frequency, the other system ports not being driven, selecting and driving the third system port with an output signal having a first frequency, the other system ports not being driven, and selecting and driving the third system port with an output signal having a first frequency, the other system ports not being driven.

Another transmitter system also provides for automatic compensation for certain phase differences in the system. The transmitter system includes an antenna array having a plurality of antennas in a symmetrical arrangement about an axis, a plurality of system ports connected to the plurality of antennas by a corresponding plurality of antenna cables, a corresponding plurality of transmitters to provide output signals to the plurality of system ports, a phase offset device to provide a corresponding plurality of phase-shifted signals to the plurality of transmitters, a plurality of phase detectors, each phase detector being connected between two system ports to measure the phase difference between the two system ports, each system port being connected to at least three phase detectors, and a processor (1) to control the phase shifts provided by the phase offset device, (2) to control the frequency of transmission, (3) to activate predetermined ones of the plurality of transmitters, (4) to receive the measured phase differences from the plurality of phase detectors, (5) to determine differential phase offsets based upon the measured phase differences at different frequencies to compensate for the differences in antenna cables, and (6) to provide an omnidirectional antenna pattern from the antenna array by providing the differential phase offsets to the phase offset device and activating the plurality of transmitters.

In one embodiment the processor determines the differential phase offsets by (a) causing each transmitter of predetermined ones of the plurality of transmitters to drive its corresponding system port with an output signal having a first frequency, the other system ports not being driven, and measuring the phase differences between the output signal at the predetermined, driven system port and return signals at predetermined, non-driven system ports, and (b) causing each transmitter of predetermined ones of the plurality of transmitters to drive its corresponding system port with an output signal having a second frequency, the second frequency being different than the first frequency, the other system ports not being driven, and measuring the phase differences between the output signal at the predetermined, driven system port and return signals at predetermined, non-driven system ports.

Another method is also for use with a system having an antenna array having a plurality of antennas in a symmetrical arrangement about an axis, a plurality of system ports connected to the plurality of antennas by a corresponding plurality of antenna cables, and a corresponding plurality of transmitters to provide output signals to the plurality of system ports, and provides for determining phase offsets necessary to compensate for differences in the antenna cables. The method includes causing each transmitter of predetermined ones of the plurality of transmitters to drive its corresponding system port with an output signal, the other system ports not being driven, starting at a first frequency, measuring the phase differences between the output signal at the driven system port and return signals at predetermined, non-driven system ports while changing the frequency in a first manner and, for each of the predetermined, non-driven system ports, marking the frequency at which a first predetermined phase condition is detected for that predetermined, non-driven system port, measuring the phase differences between the output signal at the driven system port and return signals at the predetermined, non-driven system ports while changing the frequency in a second manner and, for each of the predetermined, non-driven system ports, marking the frequency at which a second predetermined phase condition is detected for that predetermined, non-driven system port, and determining differential phase offsets based upon the marked frequencies.

In one embodiment the first phase condition is a 90 degree phase difference and the second phase condition is a next 90 degree phase difference.

In another embodiment the first phase condition is a 90 degree phase difference and the phase difference has an increasing slope with respect to frequency.

In another embodiment the first manner is a predetermined one of increasing the frequency or decreasing the frequency.

Another transmitter system also provides for automatic compensation for certain phase differences in the system. The transmitter system includes an antenna array having a plurality of antennas in a symmetrical arrangement about an axis, a plurality of system ports connected to the plurality of antennas by a corresponding plurality of antenna cables, a corresponding plurality of transmitters to provide output signals to the plurality of system ports, a phase offset device to provide a corresponding plurality of phase-shifted signals to the plurality of transmitters, a plurality of phase detectors, each phase detector being connected between two system ports to measure the phase difference between the two system ports, each system port being connected to at least three phase detectors, and a processor (1) to control the phase shifts provided by the phase offset device, (2) to control the frequency of transmission, (3) to activate predetermined ones of the plurality of transmitters, (4) to receive the measured phase differences from the plurality of phase detectors, (5) to determine differential phase offsets to compensate for the differences in antenna cables, the differential phase offsets being based upon the frequencies which produced predetermined phase differences, and (6) to provide an omnidirectional antenna pattern from the antenna array by providing the differential phase offsets to the phase offset device and activating the plurality of transmitters.

In one embodiment the processor determines the differential phase offsets by causing each transmitter of predetermined ones of the plurality of transmitters to drive its corresponding system port with an output signal, the other system ports not being driven, (a) starting at a first frequency, measuring the phase differences between the output signal at the predetermined, driven system port and return signals at predetermined, non-driven system ports while changing the frequency in a first manner, and, for each of the predetermined, non-driven system ports, marking the frequency at which a first predetermined phase condition has been detected for that predetermined, non-driven system port, and (b) measuring the phase differences between the output signal at the predetermined, driven system port and return signals at predetermined, non-driven system ports while changing the frequency in a second manner, and, for each of the predetermined, non-driven system ports, marking the frequency at which a second predetermined phase condition has been detected for that predetermined, non-driven system port.

A symmetrical S-port board for use with an Integrated Surveillance System (ISS) is also provided. The board includes four S-port cable connection points placed uniformly inside the vertices of the board, six phase detectors placed on the board, each phase detector being connected to two of the cable connection points and being placed approximately midway between those two connection points, two of the phase detectors being aligned in a first direction and being on a first side of the board, the board having a first side and a second side, two of the phase detectors being aligned in a second direction, both being on the same side of the board as each other, the same side being a predetermined one of the first side or the second side, the second direction being orthogonal to the first direction, one of the phase detectors being aligned in a first diagonal direction and being on a first predetermined side of the board, the first diagonal direction being approximately midway between the first direction and the second direction, the first predetermined side being a predetermined one of the first side or the second side, and one of the phase detectors being aligned in a second diagonal direction and being on a second predetermined side, the second diagonal direction being orthogonal to the first diagonal direction, the phase detector in the first diagonal direction being on a second predetermined side of the board, the second predetermined side being opposite to the first predetermined side.

In one embodiment the first, second, third, fourth and fifth phase detectors are placed on one side of the board, and the sixth phase detector is placed on the other side of the board.

DETAILED DESCRIPTION OF THE INVENTION

Figure 1:
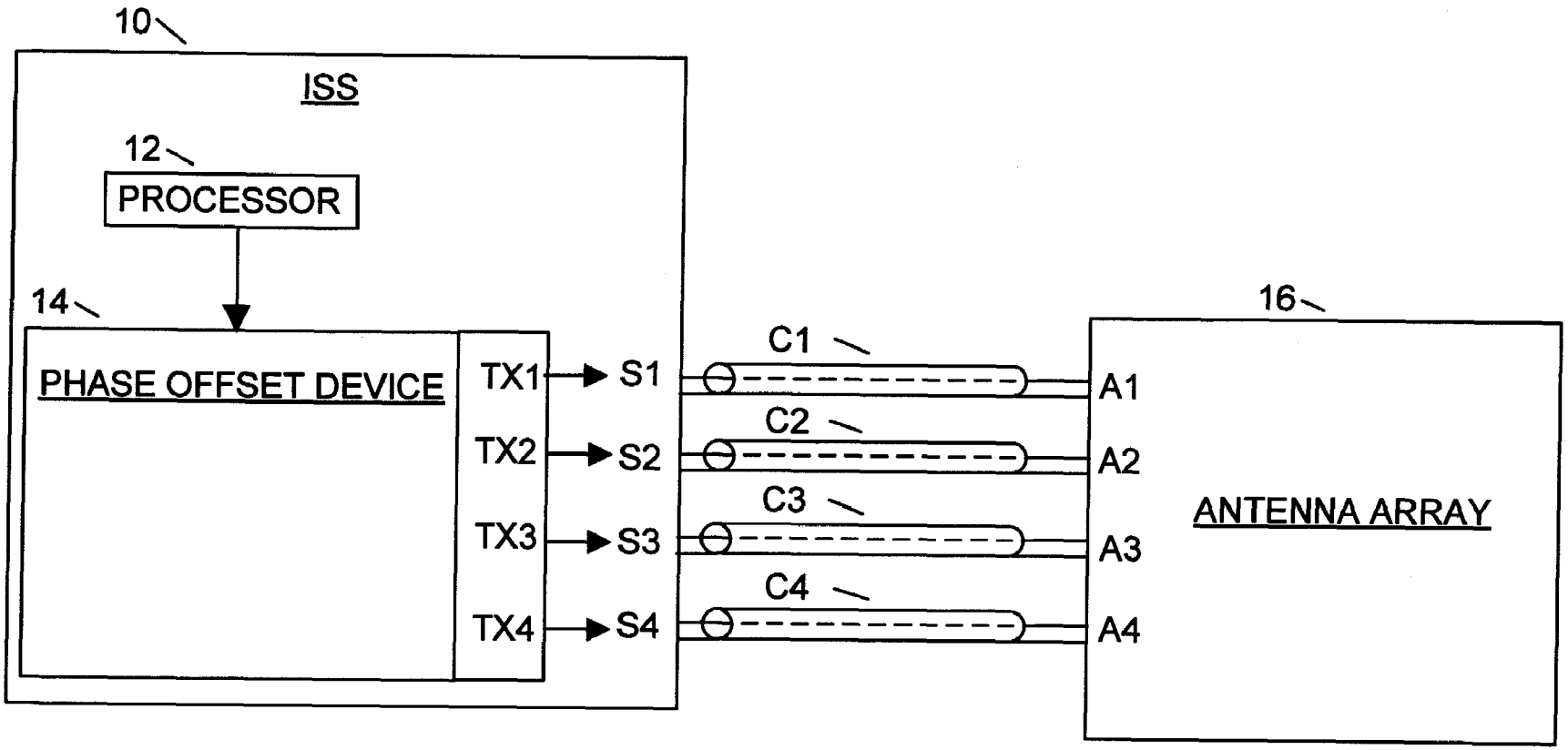
FIG. 1 is an illustration of an exemplary embodiment of the present invention in an exemplary environment.
Figure 8:
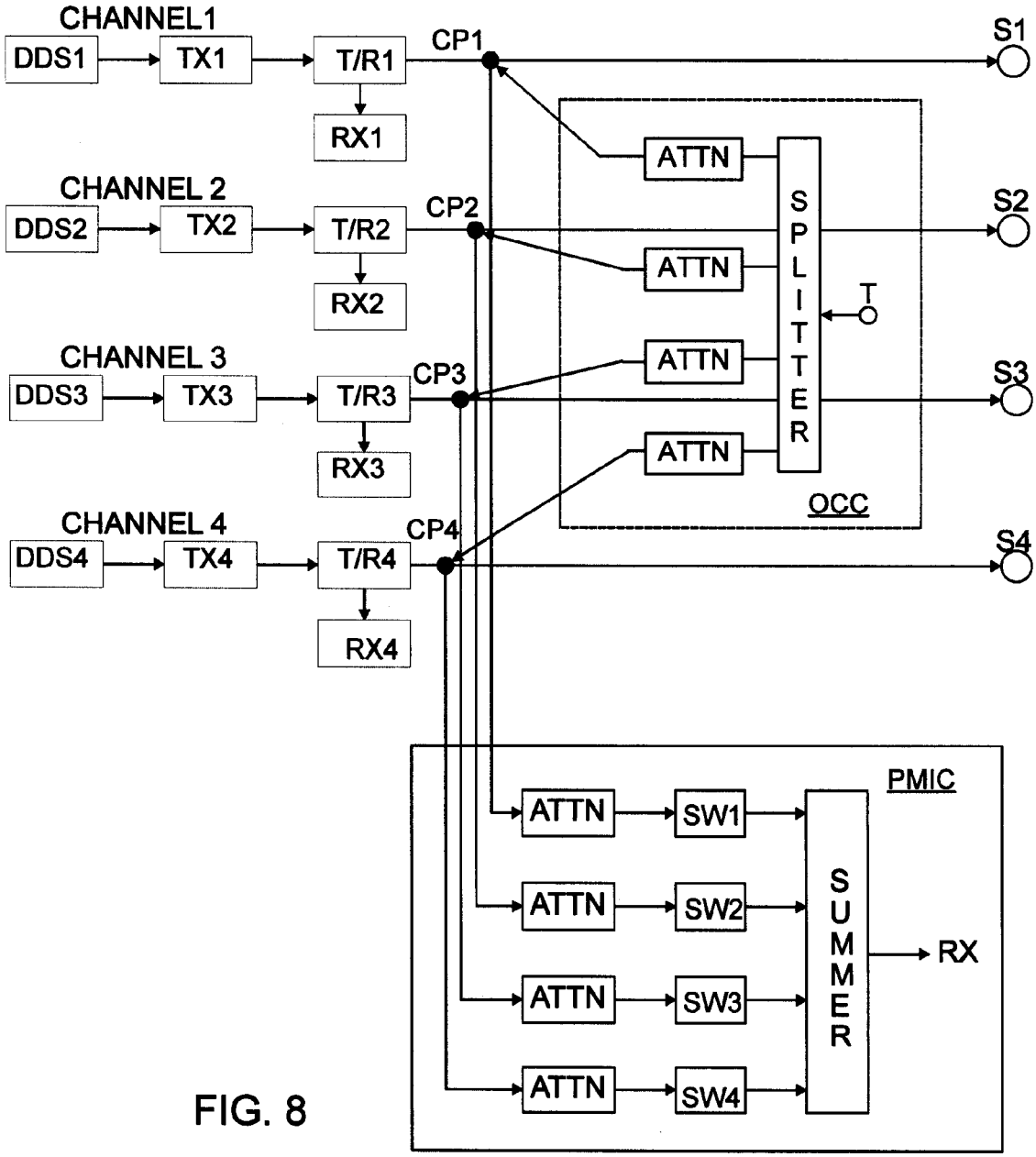
FIG. 8 is a block diagram of another implementation of an exemplary ISS system.

FIG. 1 is an illustration of an exemplary embodiment in an exemplary environment. An ISS 10 has a plurality of transmitters TX1-TX4, a receiver (or plurality of receiver circuits) (not shown), a processor 12, and a phase offset device 14. The ISS 10 also typically has, among other components (not shown), a power supply, user interface devices, memory, etc. The ISS 10 has a plurality of system ports S, each of which is driven by an independent amplifier (not shown), and the phase of each of which is independently adjustable by the phase offset device 14. These S ports are connected by a corresponding plurality of cables C to a corresponding plurality of antenna ports A of an antenna unit, such as an array 16, such as a TCAS antenna array. In the example shown, there are four system ports S1-S4, four cables C1-C4, and four antenna ports A1-A4. The phase offset device 14 preferably includes a plurality of Direct Digital Synthesizers (FIG. 8).

As mentioned, phase errors (differences) can occur at the ports S1-S4 due to the ISS device 10, between the ports S1-S4 and the antenna ports A1-A4 due to the cables C, or both. It is preferred, but not required, to compensate for both sources of error so that, when an omnidirectional antenna pattern is desired, the signals at the four antenna ports are all in phase. Preferably, the phase errors of the ISS device 10 and the phase errors in the cables C are determined, and these phase errors are combined to determine total phase errors. The total phase error information is then provided to the phase offset device 14 to compensate for the phase errors of the ISS device 10 and the cables C.

Compensating for phase errors in order to obtain an omnidirectional antenna pattern preferably comprises: (1) determining the phase offsets necessary to compensate for any differences in the components up through the ports S1-S4; (2) determining the phase offsets necessary to compensate for the different cable lengths/characteristics between the ports S and the antenna ports A; and (3) combining these phase offsets to determine and apply the resulting phase offsets; where (1) and (2) can be performed in either order.

Figure 2:
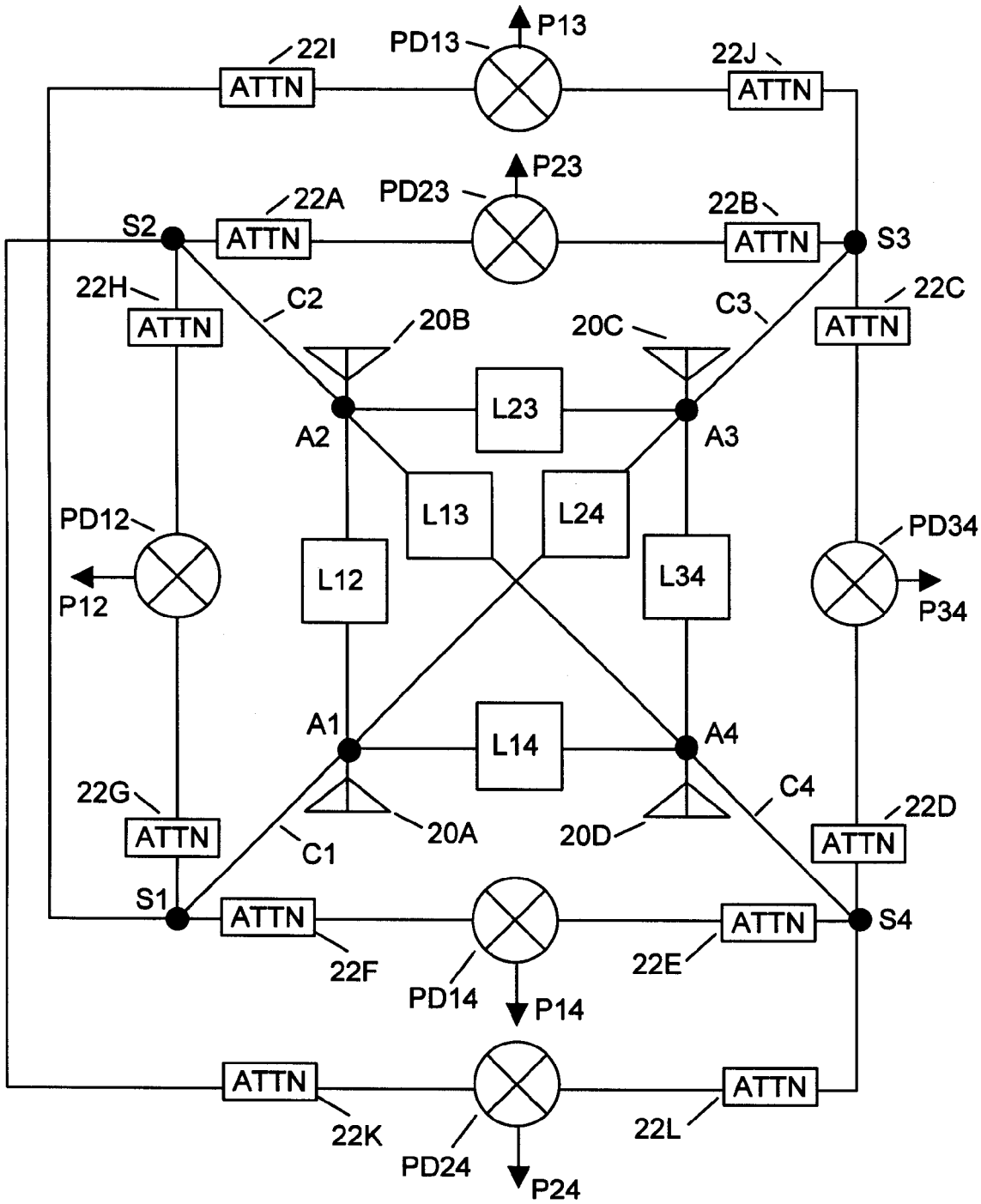
FIG. 2 is a schematic diagram of the components associated with the system and antenna ports.

Turn now to FIG. 2, which is a schematic diagram of some of the components associated with the system and antenna ports. The system ports S1-S4 are shown, connected to their corresponding antenna array ports A1-A4 by their corresponding cables C1-C4. Also shown are the four TCAS directional antennas 20A-20D. These components constitute the existing environment. One embodiment adds a plurality of phase detectors PD, a plurality of attenuators 22, and a symmetrical layout. The phase detectors are preferably surface mount devices. The attenuators 22 are used to reduce the signal strength present at the system ports S to the level appropriate for the phase detectors P and, in one embodiment, provide 30 to 40 dB of attenuation. The attenuators are also preferably surface mount devices, such a resistor pi networks to provide the desired level of attenuation and impedance matching. The selection of an appropriate value for the attenuators 22 is thus dependent upon the signal power present at the systems ports S and the input parameters for the particular phase detectors P used. The couplings L model the internal port-to-port coupling of the antenna array. In most situations this internal coupling is adequate. If, for some reason, the internal coupling is not adequate then distinct coupling components, such as attenuators, may be added.

Determining the Phase Errors Due to the ISS Device.

For determining the phase errors in the ISS device 10, only three of the phase detectors PD are needed. For example, if port S1 is used as the reference port then phase detectors PD 12, PD13 and PD14 are used. However, any of the ports could be used as the reference port, and other combinations of three of the six phase detectors could be used. The output of a phase detector PDXY is PXY; e.g., the output of PD12 is P12. The nomenclature, e.g., P12, indicates the phase of signal at port S2 with respect to the signal at port S1.

The phase detectors PDXY are used to determine the relative phase errors PXY of the output signals of the ISS device 10 at, or close to, the system ports S. For example, if the phase offset device 14 is set to zero differential, but the output signals are not in phase, then the phase offset device 14 and/or other components of the ISS device 10 may be introducing phase errors. Once these relative phase errors are measured and known, compensating phase offsets can then be applied to the phase offset device 14. For example, if the phase offset device 14 is set to provide the same phase delay (zero differential) for all S ports, but the signal at port S2 lags the signal at port S1 by 5 degrees, then the phase offset device 14 can be used to reduce the phase delay for port S2, and thereby effectively introduce a phase lead of 5 degrees so that the result, at the system ports S1 and S2, is a relative phase difference of zero, or some other relative phase difference which is acceptable. The compensating phase offsets may be applied to the phase offset device at that time, stored for future use, and/or used in combination with the differential phase offsets determined for the connecting cables C.

Figure 3A:
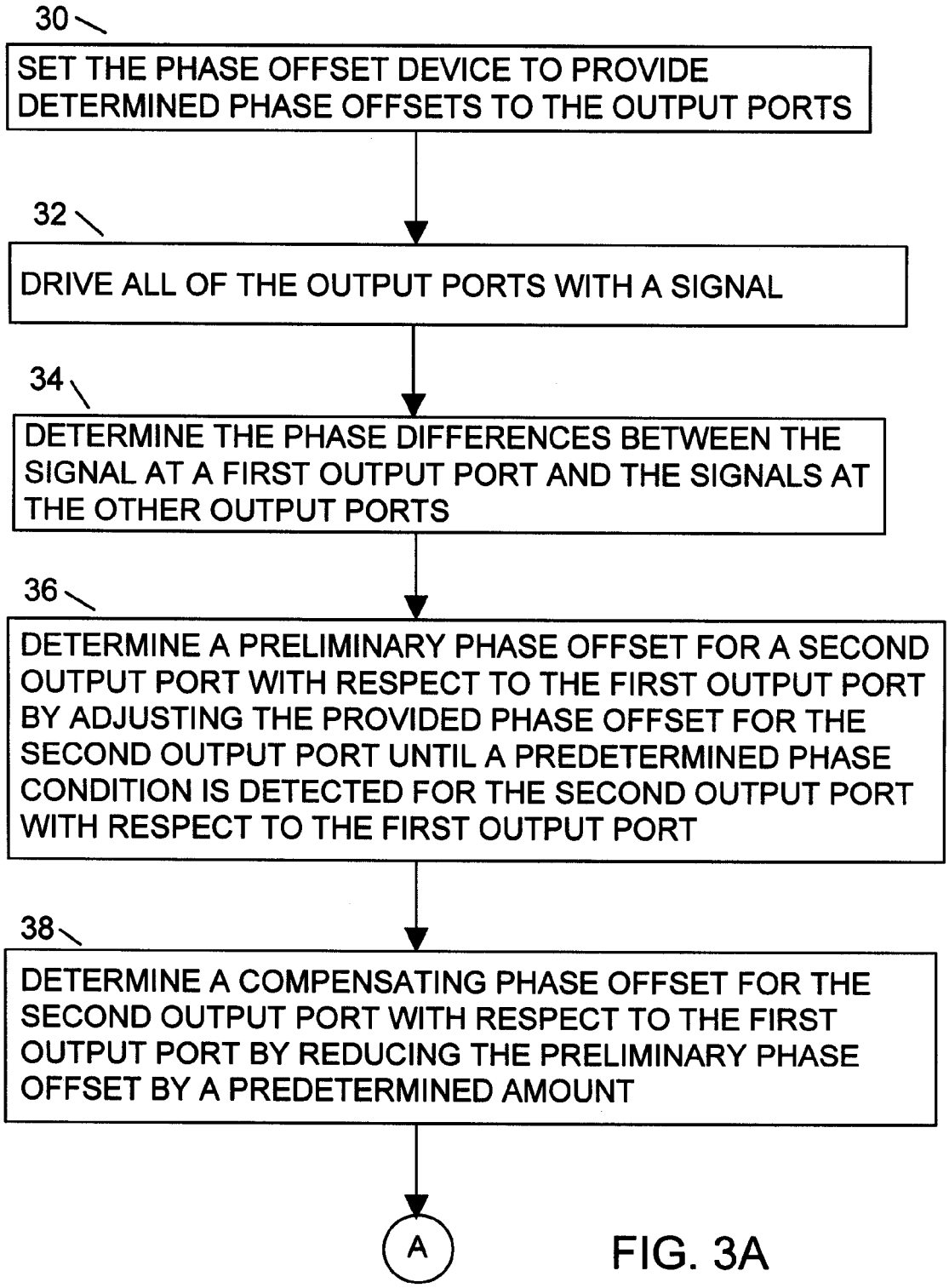
FIGS. 3A-3B are a flow chart illustrating the process of determining and compensating for phase differences in the system components.
Figure 3B:
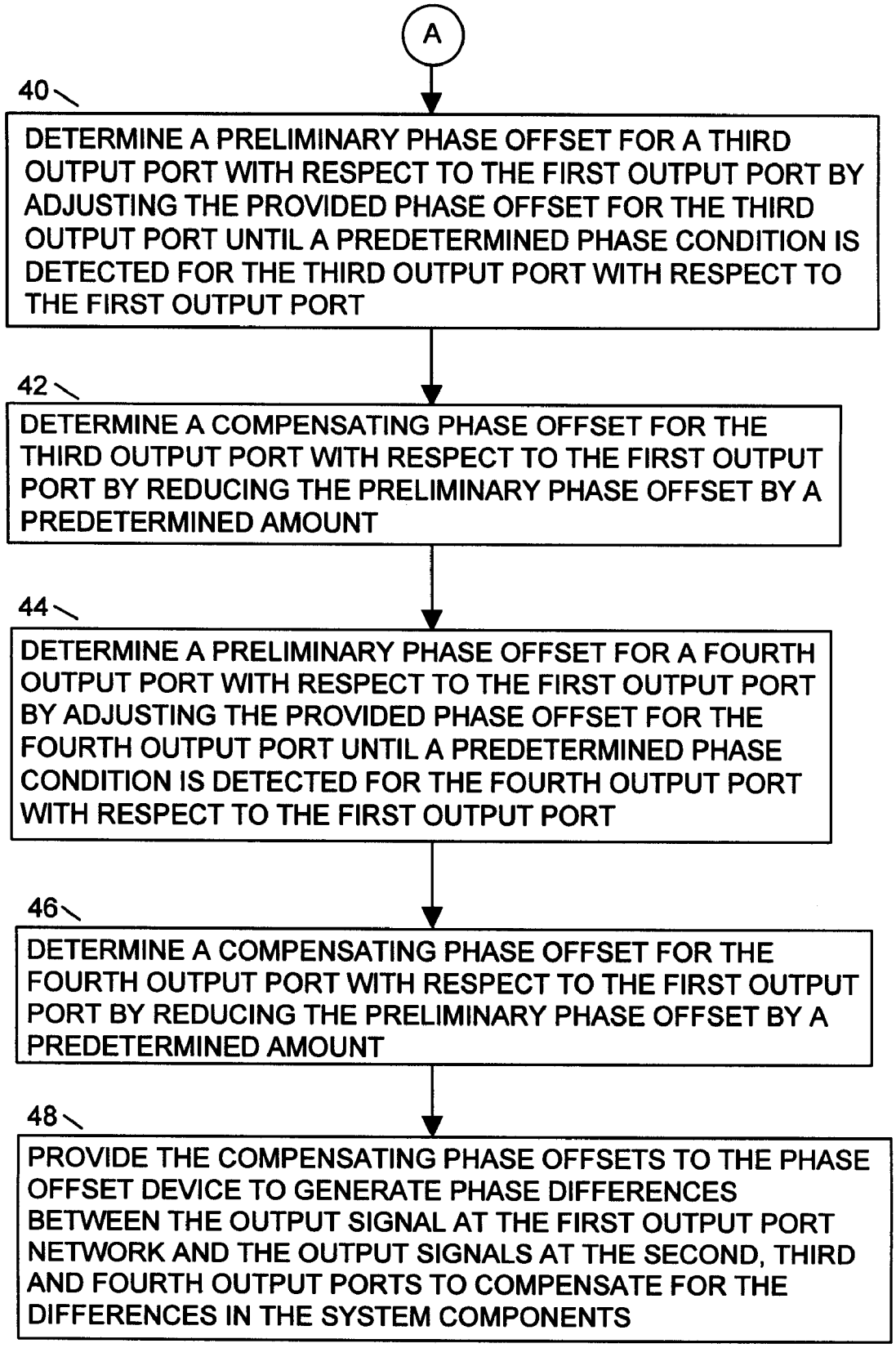

FIGS. 3A-3B are a flow chart illustrating the process of determining and compensating for these relative phase differences in the system components. The phase offset device 14 is set 30 to provide determined, zero differential, phase offsets to the system ports S. The determined phase offsets may be any desired or convenient value but are preferably initially set so as to allow at least enough phase lead or a phase lag to be introduced for a particular port to correct the phase error for that port without having to adjust the phase lead or lag for any other port.

All of the system ports are then driven 32. The frequency of this driving signal can be any frequency appropriate for the communications system in use and, for use with the ISS system, this frequency is preferably the transmitting frequency, i.e., 1090 MHz.

The phase differences between the signal at a first system port (e.g., S1) and the signals at the other system ports (e.g., S2, S3, S4) are then determined 34 using the phase detectors (e.g., PD12, PD13 and PD14, respectively).

A preliminary phase offset for a second system port (e.g., S2) is then determined 36 with respect to the first system port by adjusting the provided phase offset for the second system port until a predetermined phase condition is detected for the second system port with respect to the first system port. Using the example above, assume that port S2 leads port S1 by 5 degrees due to differences in the components of ISS 10. The provided phase offset is adjusted until the measured phase difference is the predetermined phase condition which, if the cables are not identical, will occur other than where the provided phase offset is the predetermined phase condition. A compensating phase offset for the second system port with respect to the first system port is determined 38 by altering the preliminary phase offset by the complement of the difference between the provided phase offset and the predetermined phase condition. That is, if a measured port lags the reference port by X degrees, then the phase offset device is adjusted to provide a phase lead of X degrees for that measured port.

This approach is straightforward, but suffers from inaccuracies due to the practical limitations of phase detectors, which may cause them to introduce errors into the measurement process. The output voltage of an ideal phase detector is, for example, equal to the cosine of the phase difference between its inputs and, therefore, is zero volts when the phase difference is 90 degrees. The output will vary most quickly with changes in the phase difference, and is most accurate, when the phase difference is 90 degrees or 270 (−90) degrees, and will vary least quickly with changes in the phase difference, and therefore is the least accurate, when the phase difference is zero or +/−180 degrees. It is therefore preferable that phase differences of odd multiples of 90 degrees be used to enhance the accuracy of the phase measurements.

A second source of error in phase detectors is a DC offset or bias of the phase detector. This DC bias is generally unknown, varies from device to device, and may vary with changes in temperature. If the phase detector has such a DC bias then the zero-volt crossing points will not be 180 degrees apart. That is, if there is a DC bias, then the zero-volt crossing points could be, for example, 95 degrees and 265 degrees, thus being apart only 170 degrees. To avoid this problem, it is therefore preferable that only +90 degree phase differences be used as the DC bias will be same and will cancel out for both +90 degrees and 360 degree offsets of 90 degrees (90+360*N) degrees, where N is an integer. As a matter of preference, the +90 degrees point is used, which means that the output voltage is zero, and has a positive slope (is increasing with an increasing phase difference). Of course, the −90 point could be used instead, but the slope would be negative.

Therefore, with the practical limitations of phase detectors in mind, in one embodiment the transmission frequency is not fixed at the TCAS transmission frequency but is swept, either upward and/or downward, until a predetermined phase condition is detected. In another embodiment, the predetermined phase condition is 90 degrees, which is nominally an output of zero volts (plus any DC bias which may be present), and with a positive output voltage slope with respect to an increasing phase difference.

If the DC bias of the phase detector is sufficiently small relative to the accuracy required and other factors, then the predetermined phase condition may be any desired phase as long as, in the final use, the antennas 20 are all driven with the proper phase. For example, the predetermined phase condition could be zero degrees, or 45 degrees, etc.

Using the example above, and assuming that port S2 lags port S1 by 5 degrees due to differences in the components of ISS 10, then the provided phase offset is adjusted until the measured phase difference is the predetermined phase condition, 90 degrees, which occurs when the provided phase offset reaches 95 degrees due to the 5 degree S2 lag error.

The provided phase offset, 95 degrees, is then reduced by the measured or predetermined phase condition, 90 degrees, to yield a compensating phase offset (lead) of 5 degrees. This can be readily implemented by decreasing the phase delay for port S2.

Alternatively, the phase offset device 14 may be adjusted to provide a lag of 5 degrees to port S1, or any desired combination of delay and lead values which result in the ports S1 and S2 being in phase. Adjusting S1 is not as desirable, however, as adjusting only S2 because adjusting the phase lead/lag provided to S1 will also change the difference with respect to the outputs of ports S3 and S4 with respect to S1.

Similarly, a compensating phase offset for a third system port (e.g., S3) with respect to the first system port is determined 40 by adjusting the provided phase offset for the third system port until a predetermined phase condition is detected for the third system port with respect to the first system port, and the compensating phase offset for the third system port is determined 42 by reducing the provided phase offset by the measured or predetermined phase condition.

Likewise, a compensating phase offset for a fourth system port (e.g., S4) is determined 44 with respect to the first system port by adjusting the provided phase offset for the fourth system port until the predetermined phase condition is detected for the fourth system port with respect to the first system port, and the compensating phase offset for the fourth system port is determined 46 by reducing the provided phase offset by the measured or predetermined phase condition.

The compensating phase offsets may then be provided 48 to the phase offset device to generate phase differences between the output signal at the first system port network and the output signals at the second, third and fourth system ports to compensate for the differences in the ISS system components. These compensating phase offsets may also be stored for future use, such as for use in combination with the differential phase offsets determined for the connecting cables C.

Determining the Phase Errors Due to the Antenna Cables.

As mentioned, the cables C1-C4 are not precisely measured so the phase errors due to the different lengths of these cables must be determined and compensated for. Rather than actually measuring the length of a cable, however, it is only necessary to select a reference cable, e.g., C1, and determine the phase difference due to the length of each other cable with respect to the selected reference cable. Several different procedures for accomplishing this are described herein, each having certain advantages and disadvantages, and/or making or not making certain assumptions about the operating environment. Once this differential phase shift or, equivalently, differential length, is known then a differential phase adjustment can be determined. The differential phase adjustment can then be provided to the phase offset device to generate phase differences between the output signal at the first system port and the output signals at the second, third and fourth system ports to compensate for, or offset, the differences in the cable lengths, stored for future use, used in combination with the compensating phase offsets determined for the system components, and/or used with respect to the receiver system.

To determine the differential phase delays of the cables, one system port is driven with a transmitted signal. The transmitted signal propagates down the respective cable to the respective antenna port and some portion of this transmitted signal will return via the other cables to the other, non-driven, system ports, due to the coupling between the various antennas and/or antenna ports. Measurements of frequency and/or phase are taken to determine the differential phase offsets caused by the different cable lengths. These differential phase offsets are then provided to the phase offset device to generate phase differences between the output signal at the first system port and the output signals at the second, third and fourth system ports to compensate for the differences in the cable lengths, stored for future use, and/or used in combination with the compensating phase offsets determined for the system components.

Figure 7:
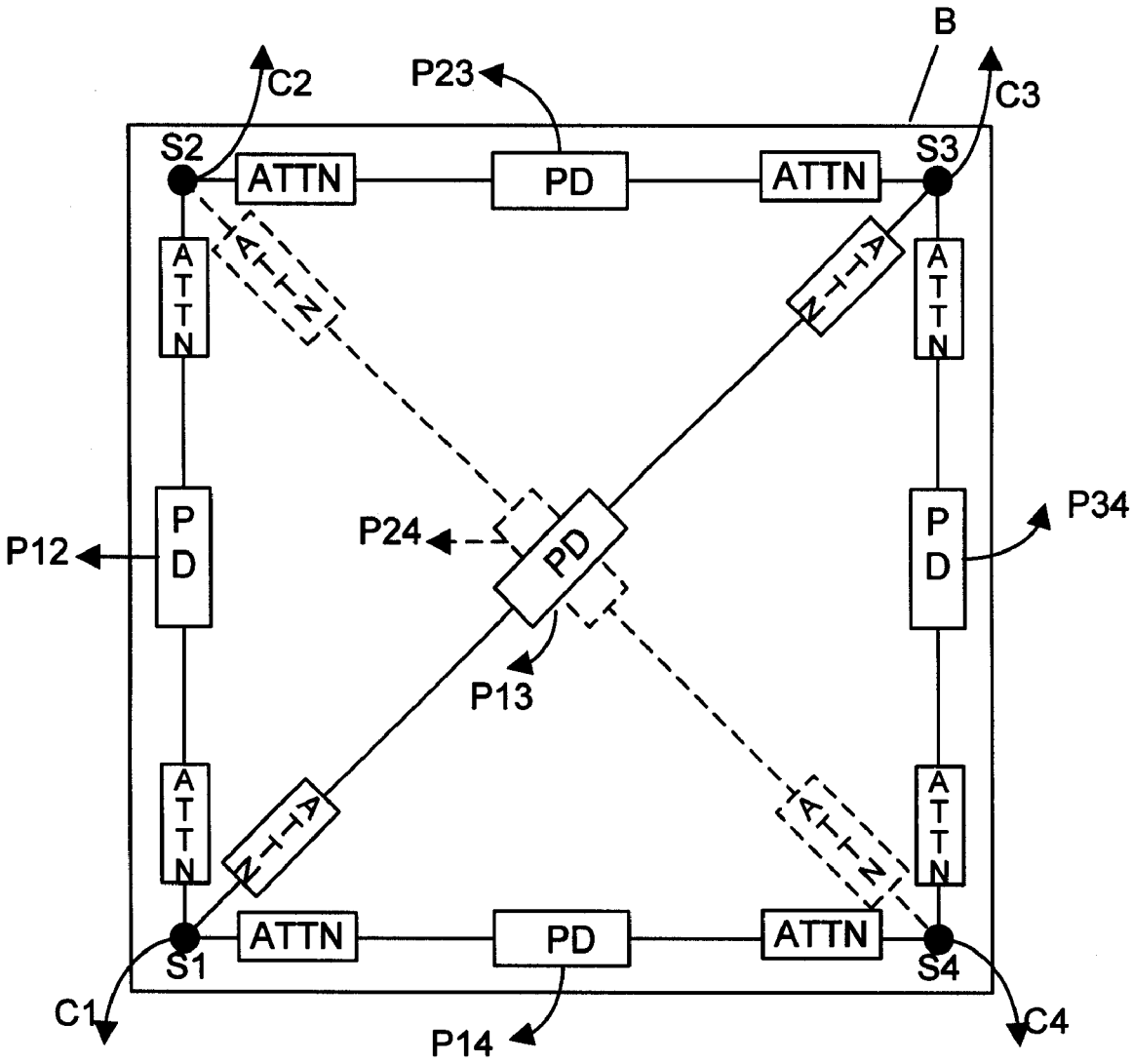
FIG. 7 is a layout of an exemplary balanced, symmetrical S-port board.

Before discussing the methods below it may be useful to review the mathematics and assumptions involved. One assumption is that the differential path lengths from the various system ports S to their connected phase detectors P are approximately equal to one another. That is, the phase shifts to the inputs of a phase detectors PDXY from its corresponding ports SX, SY are approximately equal, and the phase shifts for a phase detector one pair of ports is approximately equal to the phase shifts of its counterpart phase detector on the other pair of ports. One way of accomplishing this is to use a symmetrical S-Port output board design, such as shown in FIG. 7.

Another assumption is that the non-cable elements concerned, such as the phase detectors PD, attenuators 22, and coupling mechanisms L, are reasonably broadband, such that the change in phase shift of these elements over the frequency range of interest is essentially zero, or at least negligible as compared to the phase shift due to the cables C. Accordingly, it is preferred that the change in phase shift of the non-cable elements, over the frequency range of interest, be less than 10 degrees; even more preferably, less than 5 degrees; and even more preferably, less than 1 degree. The lower the change in phase shift of the non-cable elements over the frequency range of interest then the more accurate the measurements will be, and the closer to truly being omnidirectional the Mode S antenna pattern will be. In one embodiment the frequency range of interest is approximately 10 MHz, in another embodiment that range is 7 MHZ, in another embodiment that range is 2 MHz, and in still another embodiment that range is 1 MHz.

If the quadrature antenna arrangement of FIGS. 1 and 2 is used then it will be appreciated that, in order to obtain the desired omnidirectional antenna pattern, the transmitter phase can be arbitrary for any one of the cables, but must be adjusted to compensate for differential phase delays of the other cables relative to that cable.

A First Method of Determining Phase Errors Due to the Antenna Cables.

The loop phase shift (PXY) between two ports (SX, SY) of a cable pair is equal to the sum of the phase shift (PCX) through the cable CX from the SX port to the AX antenna port, the phase shift (PLXY) of the antenna coupling between the antenna ports, and the phase shift (PCY) through the cable CY from the AY antenna port to the SY port. Therefore, at the frequency of interest:

$$P12=PC1+PL12+PC2,$$

$$P13=PC1+PL13+PC3,$$

$$P14=PC1+PL14+PC4,$$

$$P23=PC2+PL23+PC3,$$

$$P24=PC2+PL24+PC4, \text{ and}$$

$$P34=PC3+PL34+PC4.$$

In one embodiment, the frequency F of interest is the TCAS transmitter frequency of 1090 MHz. Because of the symmetrical design and construction of the antenna board, the phase difference between antenna ports A1 and A2 is nearly identical to the phase difference between antenna ports A3 and A4, the phase difference between antenna ports A1 and A3 is nearly identical to the phase difference between antenna ports A2 and A4, and the phase difference between antenna ports A1 and A4 is nearly identical to the phase difference between antenna ports A2 and A3. Actual measurements have shown that the differential phase shift between pairs of symmetrical ports is less than 7.55 degrees. This differential phase shift between symmetrical pairs of antenna ports is defined as:

$$\begin{aligned} P3412 &= P34 - P12 \\ &= (PC3 + PL34 + PC4) - (PC1 + PL12 + PC2) \\ &= (PC3 + PC4 - PC1 - PC2) + (PL34 - PL12). \end{aligned}$$

Likewise, $$P2413 = P24 - P13, \text{ and}$$

$$P2314 = P23 - P14.$$

Note that PL34−PL12 is the difference in phase shift between coupling L34 and coupling L12. This difference can be represented as PL3412. Similarly, the difference in phase shift between coupling L24 and coupling L13 can be represented as PL2413, and the difference in phase shift between coupling L23 and coupling L14 can be represented as PL2314. Therefore, $$P3412=(PC3+PC4-PC1-PC2)+PL3412,$$

$$P2413=(PC2+PC4-PC1-PC3)+PL2413, \text{ and}$$

$$P2314=(PC2+PC3-PC1-PC4)+PL2314.$$

If cable C1 is selected as the reference cable, then the differential phase shift DPC12 of cable C2 with respect to cable C1 can be determined.

$$\begin{aligned} P2413+P2314 &= (PC2+PC4-PC1-PC3)+PL2413+ \\ &\quad (PC2+PC3-PC1-PC4)+PL2314 \\ &= 2*(PC2-PC1)+(PL2413+PL2314). \end{aligned}$$

Note that the differential phase shift DPC12 of cable C2 with respect to cable C1 is PC2−PC1. Therefore, $$P2413+P2314=2*DPC12+(PL2413+PL2314).$$

Solving for DPC12, $$DPC12=((P2413+P2314)-(PL2413+PL2314))/2$$

The term (PL2413+PL2314)/2 represents errors due to, for example, non-symmetry in the antenna board and/or the coupling elements. These are small errors and are presumed to be zero. Accordingly, $DPC12=(P2413+P2314)/2$. Similarly, $DPC13=(P3412+P2314)/2$, and $DPC14=(P3412+P2413)/2$.

Expanding these terms yields:

$$\begin{aligned} DPC12 &= (P2413+P2314)/2 \\ &= (P24-P13+P23-P14)/2 \\ DPC13 &= (P3412+P2314)/2 \\ &= (P34-P12+P23-P14)/2 \\ DPC14 &= (P3412+P2413)/2 \\ &= (P34-P12+P24-P13)/2. \end{aligned}$$

Now, P12, P13, P14, P23, P24, and P34 are known, having been measured, so DPC12, DPC13 and DPC14 can easily be determined. As the difference in phase shifts caused by these cables is known, these differences can be applied to the phase offset device to provide an offsetting phase shift, i.e., −DPC21, −DPC31, and −DPC41. For example, as mentioned in the first method described above for determining the phase error due to the cables, if DPC21 is 5degrees, that is, cable C2 causes a phase shift delay of 5 degrees more than the phase shift delay of cable C1, then the phase offset device would be adjusted to provide 5 degrees less delay to port S2 than it applies to port S1.

Figure 4A:
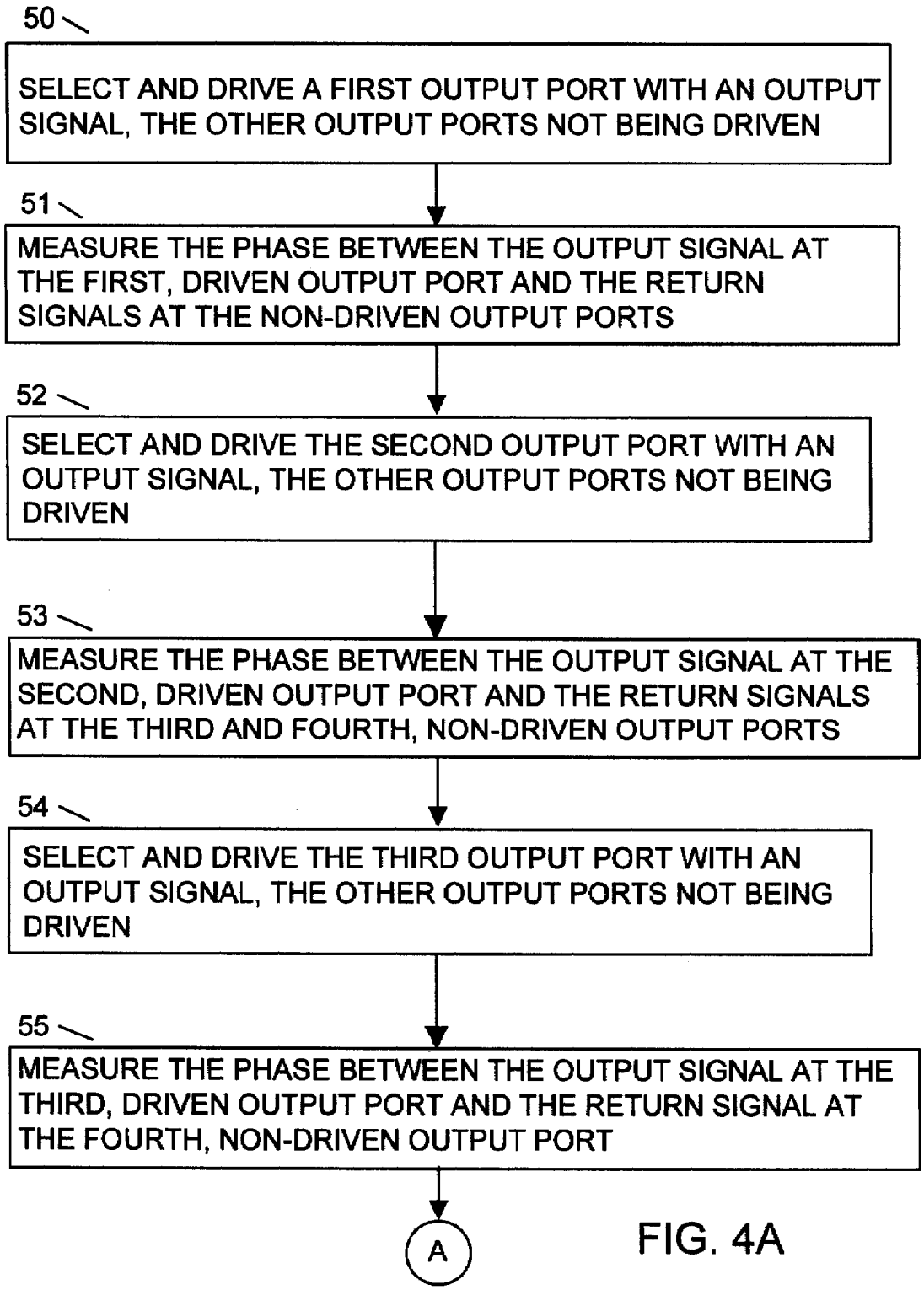
FIGS. 4A-4B are a flow chart illustrating one process of determining and compensating for phase differences in the antenna cables.
Figure 4B:
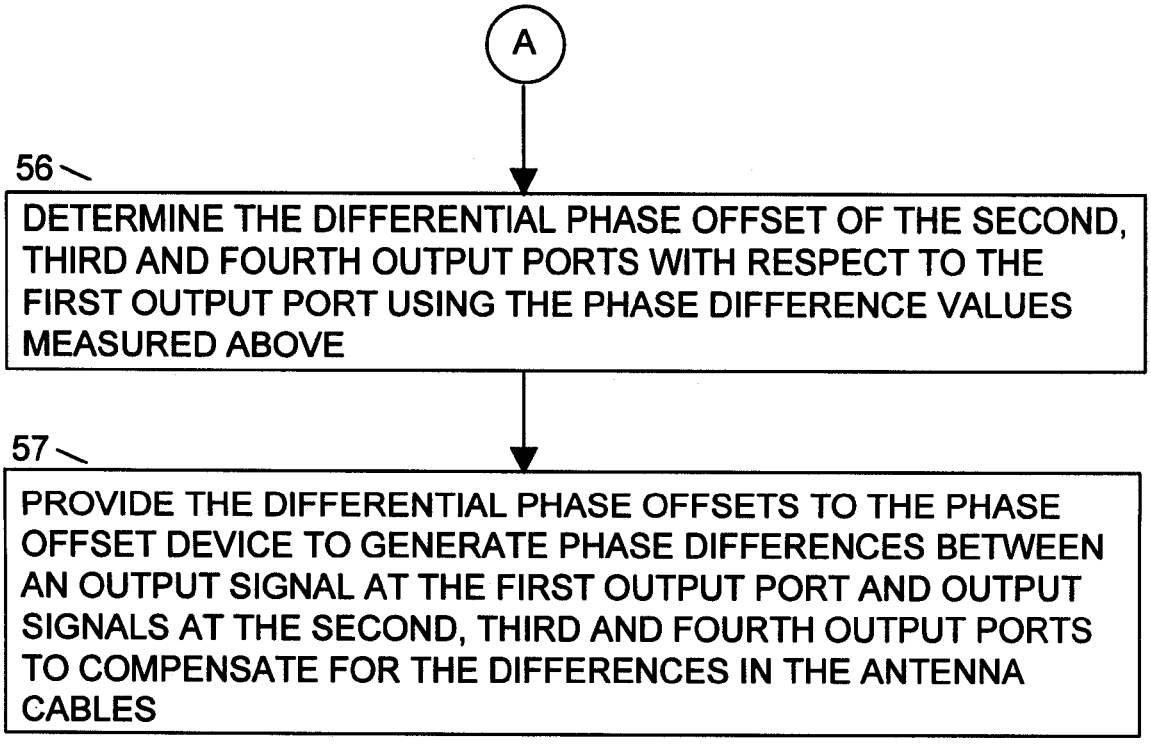

FIGS. 4A-4B are a flow chart illustrating the above first process of determining and compensating for phase differences in the antenna cables. A first system port (e.g., S1) is selected and driven 50 with an output signal, the other system ports (e.g., S2, S3, and S4) are not driven. In one embodiment the signal frequency is 1090 MHz. In another embodiment, the signal is varied in phase until a detected phase difference of 90 degrees is obtained, for the reasons described later herein. The phase between the output signal at the first, driven system port and the return signals at the second, third, and fourth non-driven system ports (e.g., S2, S3, and S4, respectively) are then measured 51 to provide P12, P13 and P14, respectively.

The process is then repeated, but with the second port (S2) being driven 52, and the other ports (S1, S3, S4) not being driven, the phase between the output signal at the second, driven system port and the return signals at the third and fourth non-driven system ports (e.g., S3 and S4, respectively) are then measured 53 to provide P23 and P24, respectively.

The process is then repeated, but with the third port (S3) being driven 54, and the other ports (S1, S2, S4) not being driven, the phase between the output signal at the third, driven system port and the return signal at the fourth non-driven system port (e.g., S4) is then measured 55 to provide P34.

The differential phase offsets needed to compensate for the differences in the antenna cables (C) between the system ports S and the respective antenna ports A are then determined 56 using these measured phase differences.

These differential phase offsets are then provided 57 to the phase offset device to generate the appropriate phase differences to compensate for the differences in the antenna cables (C) between the system ports S and the respective antenna ports A.

A Second Method of Determining Phase Errors Due to the Antenna Cables.

If one input to a phase detector, such as P12 is, for example, the transmitted signal at port S1; and the other input to the phase detector is the return signal at port S2, then this return signal at port S2 has been phase shifted (delayed), with respect to the signal at port S1, by the transit time through cable C1, by the phase characteristics of the antenna coupling element L12, and by the transit time through cable C2. One may consider this to be the loop phase shift for the loop defined by a port pair, or the difference between the phases at port S2 and port S1 at the frequency of interest. If the calibration transmissions are made at frequencies F1 and F2, then the loop phase shifts measured by phase detector P12 will be P12F1 and P12F2 respectively, the phase shift caused by cable C1 will be PC1F1 and PC1F2, respectively, the phase shift through the antenna coupling element L12 will be PL12F1 and PL12F2, respectively, and the phase shift caused by cable C2 will be PC2F1 and PC2F2, respectively. Similar paths and delays result with respect to the ports pairs S1 and S3, S1 and S4, S2 and S3, S2 and S4, and S3 and S4.

Consider now that if a cable C has a propagation velocity of 70% the speed of light in a vacuum (0.7 c), then at a frequency of F=1090 MHz, a 100 foot cable C, of which there are four, C1-C4, represents approximately 158.246 wavelengths, and at a frequency of F=1091 MHz that same cable represents approximately 158.391 wavelengths. The difference in the phase, due to the change in frequency, with the two frequencies being 1 MHz apart, is approximately 0.145 wavelengths, or approximately 52 degrees. Thus, for that 100 foot cable C, if the frequency of operation shifts by 1 MHz then the phase shift of that cable C will change by approximately 52 degrees; if the frequency shift is 2 MHz, then the phase shift of that cable C will change by approximately 104 degrees, etc.

The loop phase shift for each cable pair is the phase difference as measured at the two ports, and at frequency F1 and at frequency F2 are:

P12F1, P13F1, P14F1, P23F1, P24F1, P34F1, and P12F2, P13F2, P14F2, P23F2, P24F2, P34F2, where P12F1 is the phase difference between ports S1 and S2 at frequency F1 as measured by the phase detector P12, and P13F2 is the difference between ports S1 and S3 at frequency F2 as measured by the phase detector P13, etc.

From viewing the signal path, it is seen that:

$P12F1=PC1F1+PL12F1+PC2F1$, $P13F1=PC1F1+PL13F1+PC3F1$, $P14F1=PC1F1+PL14F1+PC4F1$, $P23F1=PC2F1+PL23F1+PC3F1$, $P24F1=PC2F1+PL24F1+PC4F1$, $P34F1=PC3F1+PL34F1+PC4F1$, $P12F2=PC1F2+PL12F2+PC2F2$, $P13F2=PC1F2+PL13F2+PC3F2$, $P14F2=PC1F2+PL14F2+PC4F2$, $P23F2=PC2F2+PL23F2+PC3F2$, $P24F2=PC2F2+PL24F2+PC4F2$, and $P34F2=PC3F2+PL34F2+PC4F2$.

The difference in the loop (port-to-port) phase shift for a cable pair with the change in frequency from F1 to F2 is defined as DPXY, where DP21 is the differential phase shift with respect to frequency between ports S2 and S1, DP32 is the differential phase shift with respect to frequency between ports S3 and S2, etc. So, for example, the differential phase shift DP21, between ports S1 and S2, as a result of the change in frequency from F1 to F2, is obtained by subtracting the phase shift at frequency F1 from the phase shift at frequency F2.

$$\begin{aligned} DP21 &= P12F2 - P12F1 \\ &= (PC1F2 + PL12F2 + PC2F2) - (PC1F1 + PL12F1 + PC2F1) \\ &= (PC1F2 - PC1F1) + (PC2F2 + PC2F1) + (PL12F2 - PC12F1) \end{aligned}$$

The phase shift of a cable varies at the rate of about 52 degrees per MHz for 100 feet of cable. In contrast, the phase shift with frequency through the coupling L is negligible for the relatively small frequency shifts involved (less than 10 MHz) because the coupling is broadband. That is, it is presumed that the phase change of the coupler L12 is reasonably constant about the frequency of interest so PL12F2 is approximately equal to PL12F1, and so $$DP21=(PC1F2-PC1F1)+(PC2F2-PC2F1)$$

The change in the phase shift for a particular cable (N) with the change in frequency from F1 to F2 is DPN, where DPN=PCNF2−PCNF1, and PCNF1 is the phase shift of cable CN at frequency F1. Thus, $$DP1=PC1F2-PC1F1,$$

$$DP2=PC2F2-PC2F1,$$

$$DP3=PC3F2-PC3F1, \text{ and}$$

$$DP4=PC4F2-PC4F1.$$

Accordingly, the change in phase shift with respect to frequency for any two cables is the sum of the individual changes in phase shift with respect to frequency, so DPXY, is also equal to the sum DPX and DPY. Therefore, $$DP21=DP1+DP2=P12F2-P12F1$$

$$DP31=DP1+DP3=P13F2-P13F1$$

$$DP41=DP1+DP4=P14F2-P14F1$$

$$DP32=DP3+DP2=P23F2-P23F1$$

$$DP42=DP4+DP2=P24F2-P24F1$$

$$DP43=DP4+DP3=P34F2-P34F1.$$

One can pick two cable pairs which have a common cable and, as the phase shift due to the common cable will be the same for both pairs, the difference between the phase shift of one cable pair and the phase shift of the other cable pair can be determined, and this difference will be due to the differences in the phase shift of the non-common cable in each pair. For example, if the phase shift between ports 1 and 2 is X degrees, and the phase shift between ports 1 and 3 is Y degrees, then the phase difference (X−Y) is due to the difference in the lengths of cables 2 and 3. So, $$\begin{aligned} DPC21 &= DP32 - DP31 \\ &= (P23F2 - P23F1) - (P13F2 - P13F1) \\ &= P13F1 + P23F2 - P13F2 - P23F1 \end{aligned}$$

$$\begin{aligned} DPC31 &= DP43 - DP41 \\ &= (P34F2 - P34F1) - (P14F2 - P14F1) \\ &= P14F1 + P34F2 - P14F2 - P34F1 \end{aligned}$$

$$\begin{aligned} DPC41 &= DP42 - DP21 \\ &= (P24F2 - P24F1) - (P12F2 - P12F1) \\ &= P24F2 + P12F1 - P24F1 - P12F2. \end{aligned}$$

The difference in phase shift between cables 1 and 2 is DPC21, the difference in phase shift between cables 1 and 3 is DPC31, and the difference in phase shift between cables 1 and 4 is DPC41. In addition, as P12F1, P13F1, etc., are all known (measured by the corresponding phase detectors) DPC21, DPC31 and DPC41 can be determined. Once these differences in phase shifts caused by these cables is known, these differences can be applied to the phase offset device to provide an offsetting phase shift, i.e., −DPC21, −DPC31, and −DPC41. For example, if DPC21 is 5 degrees, that is, cable C2 causes a phase shift delay of 5 degrees more than the phase shift delay of cable C1, then the phase offset device would be adjusted to provide 5 degrees less delay to port S2 than it applies to port S1. The current regulations regarding Mode-S transmissions require the transmission frequency to be 1090 MHz, plus or minus 1 MHz. Therefore, F2−F1 may be 2 MHz. Preferably, however, F2−F1 is approximately 1 MHz, as mentioned above.

Figure 5A:
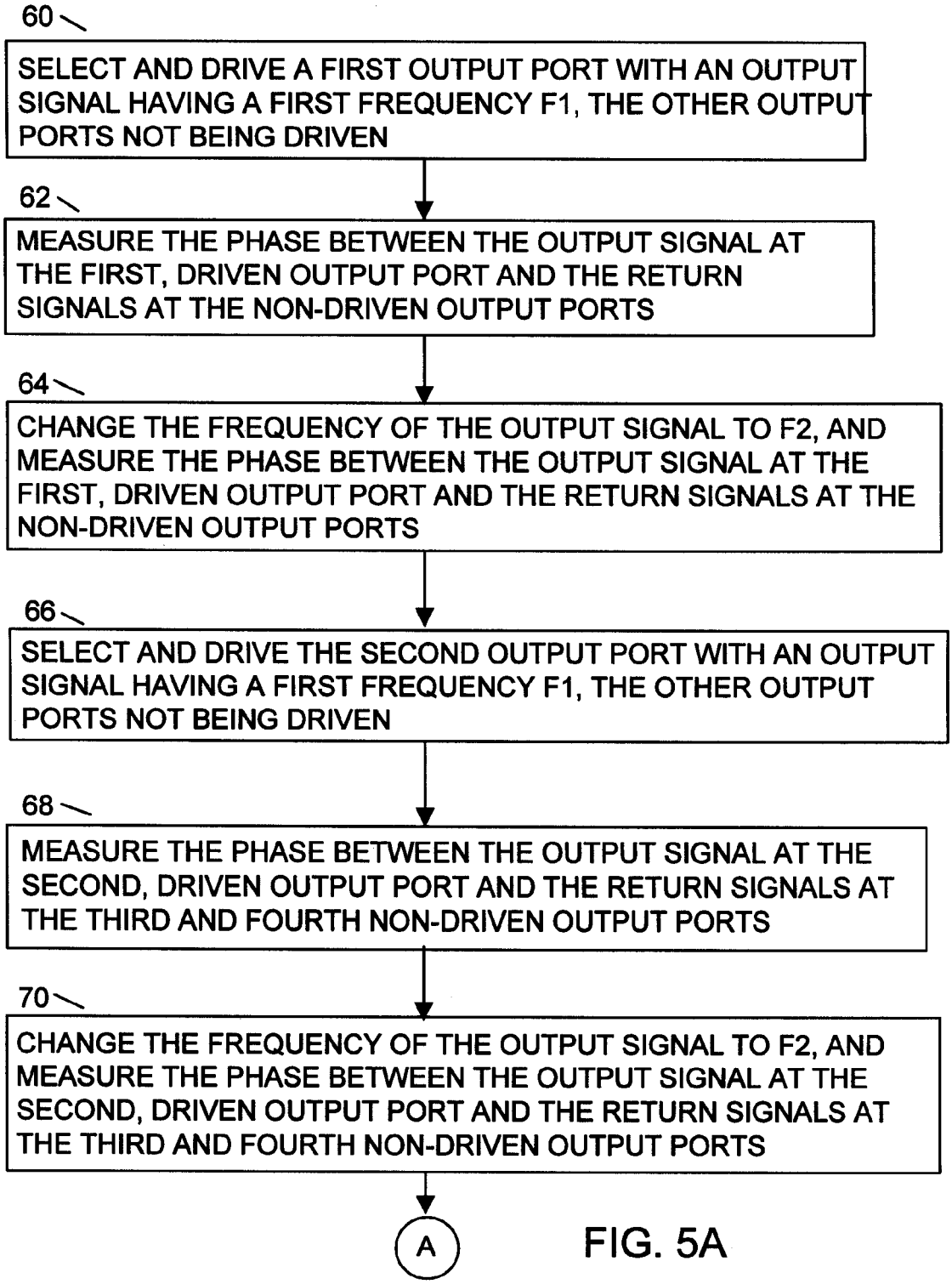
FIGS. 5A-5B are a flow chart illustrating a second process of determining and compensating for phase differences in the antenna cables.
Figure 5B:
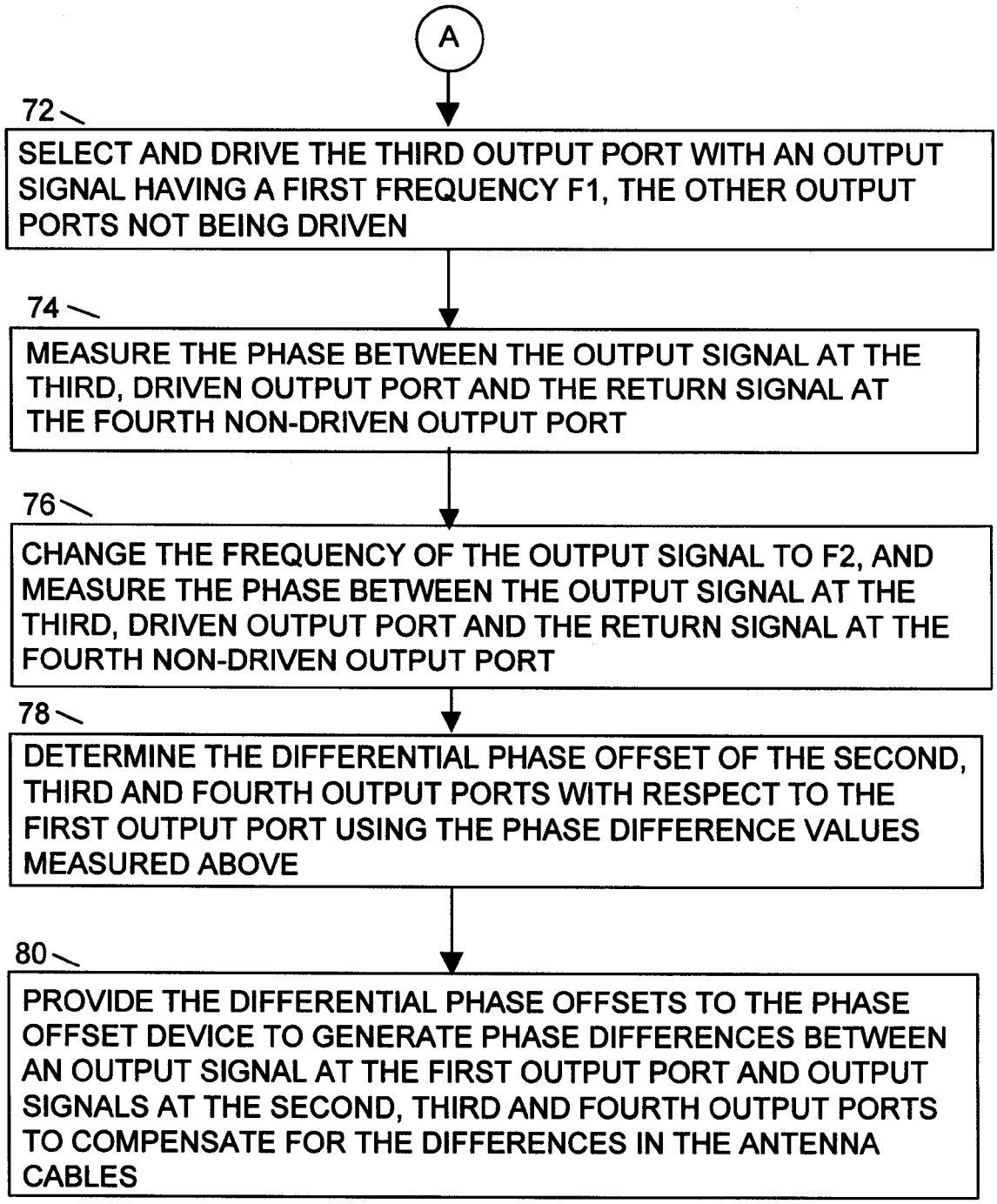

FIGS. 5A-5B are a flow chart illustrating the second process of determining and compensating for phase differences in the antenna cables.

A first system port (e.g., S1) is selected and driven 60 with an output signal at a first frequency F1, the other system ports (e.g., S2, S3, and S4) are not driven. The phase differences between the output signal at the first, driven system port and the return signals at the non-driven system ports (e.g., S2, S3 and S4) are then measured 62 to provide P121, P131 and P141, respectively.

The frequency is then changed to F2, and the phase differences between the output signal at the first, driven system port and the return signals at the non-driven system ports are then measured 64 to provide P122, P132 and P142, respectively.

The frequency is then changed to F1, and process is then repeated, but with the second port (S2) being driven 66, and the other ports (S1, S3, S4) not being driven, and the phase differences between the output signal at the second, driven system port and the return signals at the third and fourth non-driven system ports are then measured 68 to provide P231 and P241, respectively.

The frequency is then changed to F2, and the phase differences between the output signal at the second, driven system port and the return signals at the third and fourth non-driven system ports are then measured 70 to provide P232 and P242, respectively.

The frequency is then changed to F1, and process is then repeated, but with the third port (S3) being driven 72, and the other ports (S1, S2, S4) not being driven, and the phase difference between the output signal at the third, driven system port and the return signals at the fourth non-driven system ports is then measured 74 to provide P341.

The frequency is then changed to F2, and the phase difference between the output signal at the third, driven system port and the return signals at the fourth non-driven system port is then measured 76 to provide P342.

The differential phase offsets needed to compensate for the differences in the antenna cables (C) between the system ports S and the respective antenna ports A are then determined 78 using the measured phase differences P121, P122, P131, etc.

These differential phase offsets are then provided 80 to the phase offset device to generate the appropriate phase differences to compensate for the differences in the antenna cables (C) between the system ports S and the respective antenna ports A.

A Third Method of Determining Phase Errors Due to the Antenna Cables.

As mentioned earlier, phase detectors can be a source of error and this error is minimized when the phase difference is near 90 degrees (zero output voltage with a positive slope with respect to the phase difference). In one method described above, the frequency is changed from F1 to F2, and phase differences are measured, but these measurements may not be sufficiently accurate if, for the frequencies F1 and F2 chosen, the phase difference at one or both frequencies is near zero degrees. Therefore, in order to improve the accuracy of the results, F1 and F2 are not predetermined. Rather, the frequency is changed in one direction, e.g., decreased, until the phase difference is 90 degrees, and that frequency is recorded as, for example, F1, for that port pair. The frequency is then changed in the opposite direction, e.g., increased, until a subsequent 90 degree phase difference is encountered, and that frequency is recorded as, for example, F2, for that port pair. This is then repeated for the next port pair so that, rather than measuring phase differences at predetermined frequencies F1 and F2, the frequencies F1 and F2 are independently determined for each port pair by varying the frequency until a predetermined phase difference is detected.

Preferably, the predetermined phase difference is either 90 or 270 degrees. Also, preferably, the subsequent 90 degree phase is 360*N degrees difference from the first 90 degree difference. Even more preferably, N=1. Also, preferably, at the 90 degree difference point, the output of the phase detector has a rising slope with respect to an increase in the phase difference.

FXYN is the frequency at which a first (N=1) or a subsequent (N=2) 90 degree phase difference is detected between ports SX and SY. Thus, F121 is the frequency at which the first 90 degree phase difference is obtained with respect to ports S1 and S2;

F122 is the frequency at which the subsequent 90 degree phase difference is obtained with respect to ports S1 and S2;

F131 is the frequency at which the first 90 degree phase difference is obtained with respect to ports S1 and S3;

F132 is the frequency at which the subsequent 90 degree phase difference is obtained with respect to ports S1 and S3;

F141 is the frequency at which the first 90 degree phase difference is obtained with respect to ports S1 and S4;

F142 is the frequency at which the subsequent 90 degree phase difference is obtained with respect to ports S1 and S4;

F231 is the frequency at which the first 90 degree phase difference is obtained with respect to ports S2 and S3;

F232 is the frequency at which the subsequent 90 degree phase difference is obtained with respect to ports S2 and S3;

F241 is the frequency at which the first 90 degree phase difference is obtained with respect to ports S2 and S4;

F242 is the frequency at which the subsequent 90 degree phase difference is obtained with respect to ports S2 and S4;

F341 is the frequency at which the first 90 degree phase difference is obtained with respect to ports S3 and S4; and F342 is the frequency at which the subsequent 90 degree phase difference is obtained with respect to ports S3 and S4.

The change in frequency, DFXY, for a port pair, between these consecutive 90 degree phase difference points, is the frequency change required to obtain a 360 degree phase shift between the two ports. Accordingly, $$DF12=F122-F121,$$

$$DF13=F132-F131,$$

$$DF14=F142-F141,$$

$$DF23=F232-F231,$$

$$DF24=F242-F241, \text{ and}$$

$$DF34=F342-F341.$$

If LXY is the total length of cable CX plus the length of cable CY between two ports SX and SY, then it can be shown that:

LXY=(V/DFXY)*(PhaseShiftChange/360). "PhaseShiftChange" is 360 degrees (the next occurrence of the 90 degree phase condition), so the total lengths of the cables between two ports SX and SY is: LXY=V/DFXY. Therefore, $$L12=V/DF12,$$

$$L13=V/DF13,$$

$$L14=V/DF14,$$

$$L23=V/DF23,$$

$$L24=V/DF24, \text{ and}$$

$$L34=V/DF34.$$

If a cable CX is to be the reference cable, then the difference in length between cables CX and CY can be found by comparing CX and CY with another cable, such as a cable CZ. Thus, the difference in length between cable CX and cable CY is:

$$\begin{aligned} DLXY &= LYZ - LXZ \\ &= (LY + LZ) - (LX + LZ) \\ &= LY - LX. \end{aligned}$$

If cable C1 is selected as the reference cable, then:

$$DL12=L23-L13,$$

$$DL13=L34-L14, \text{ and}$$

$$DL14=L24-L12.$$

Now that the differences in cable lengths DLXY are known, the differential phase shift (DPC) of one cable with respect to another cable can be determined using the following relationships:

$$DPCXY = DLXY / LAMBDA * 360, \text{ where } LAMBDA = V / F.$$

$$DLXY = LYZ - LXZ,$$

$$LYZ = V / DFYZ,$$

$$LXZ = V / DFXZ,$$

-continued $DFYZ = FYZ2 - FYZ1$, and $DFXZ = FXZ2 - FXZ1$. So, inserting terms:

$$\begin{aligned} DPCXY &= (LYZ - LXZ)/(V/F)*360 \\ &= 360*F*(LYZ - LXZ)/V \\ &= 360*F*(V/DFYZ - V/DFXZ)/V \\ &= 360*F*(1/DFYZ - 1/DFXZ) \\ &= 360*F*(1/(FYZ2 - FYZ1) - 1/(FXZ2 - FXZ1)). \end{aligned}$$

Therefore, $DPC12 = 360*F*(1/(F232 - F231) - 1/(F132 - F131))$, $DPC13 = 360*F*(1/(F342 - F341) - 1/(F142 - F141))$, and $DPC14 = 360*F*(1/(F242 - F241) - 1/(F122 - F121))$.

For the *TCAS* transmitter situation, $F = 1090$ MHz.

The difference in phase shift between cables 1 and 2 is DPC12, the difference in phase shift between cables 1 and 3 is DPC13, and the difference in phase shift between cables 1 and 4 is DPC14 can now be determined as F122, F121, F132, F131, etc., are all known (determined by measurement as described above). As the difference in phase shifts caused by these cables is known, these differences can be applied to the phase offset device to provide an offsetting phase shift, i.e., −DPC121, −DPC13, and −DPC14. For example, as mentioned in the first method described above for determining the phase error due to the cables, if DPC12 is 5 degrees, that is, cable C2 causes a phase shift delay of 5 degrees more than the phase shift delay of cable C1, then the phase offset device would be adjusted to provide 5 degrees less delay to port S2 than it applies to port S1.

One can, as described above, monitor P12, start decreasing the frequency until F121 is found, then increase the frequency until F122 is found, then go back to the starting frequency and monitor P13, decreasing the frequency until F131 is found, and then increasing the frequency, etc.; then determine the relevant frequencies for port pairs 23 and 24 and, finally, determine the relevant frequencies for port pair 34. Alternatively, a port, e.g., S1, can be selected and driven, and the frequency decreased while monitoring three phase detector outputs (P12, P13, P14) until a first 90 degree difference has been found for each of the other ports (S2, S3, S4) and the corresponding frequency (F121, F131, etc.) noted. The frequency is then increased until the next 90 degree difference has been found for each of the ports and the corresponding frequency (F122, F132, etc.) noted. The next port, e.g., S2, can be selected and driven, and the relevant frequencies determined for, e.g., S3 and S4. Finally, S3 can be selected and driven and the relevant frequencies determined for S4.

Figure 6A:
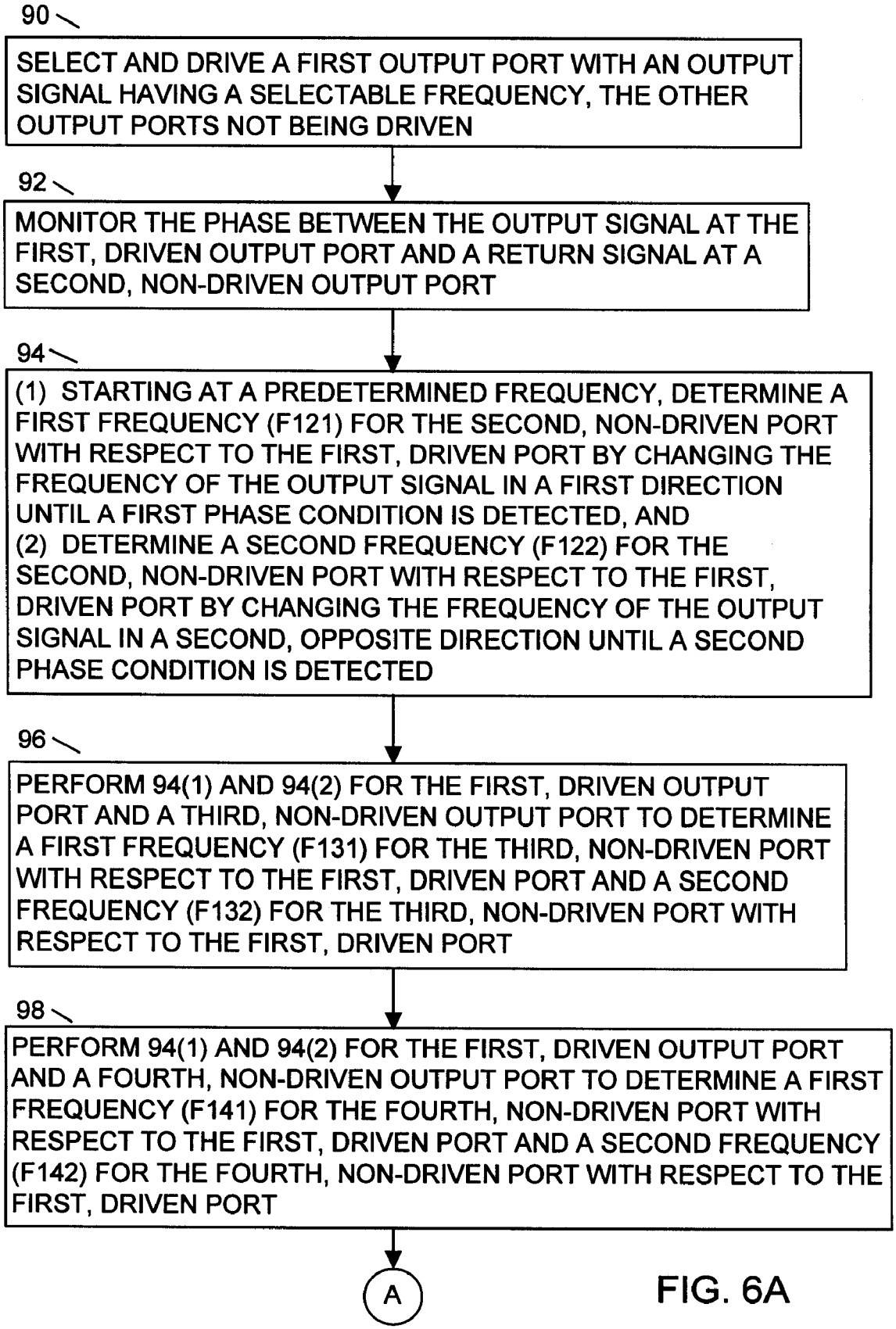
FIGS. 6A-6C are a flow chart illustrating a third process of determining and compensating for phase differences in the antenna cables.
Figure 6B:
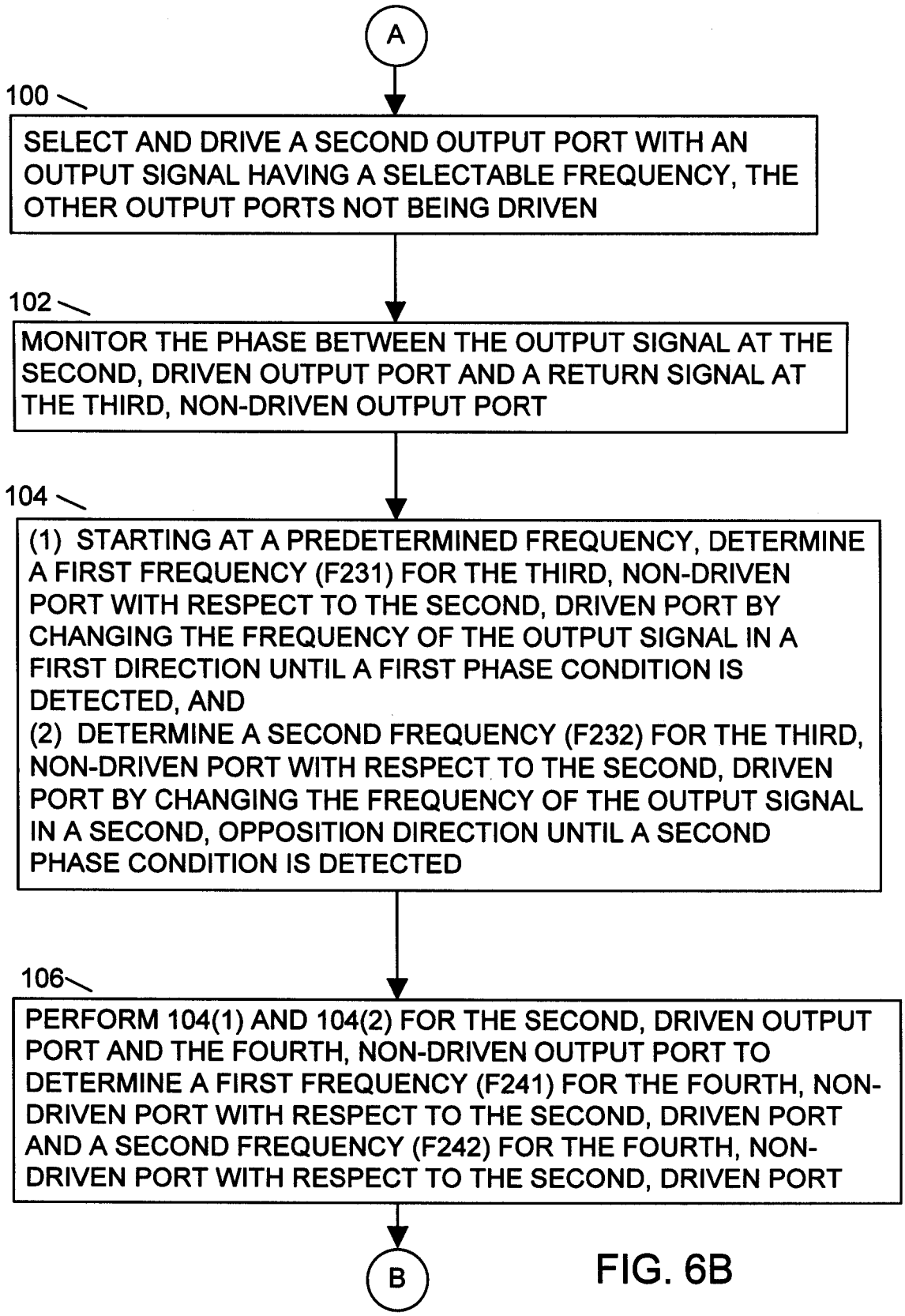
Figure 6C:
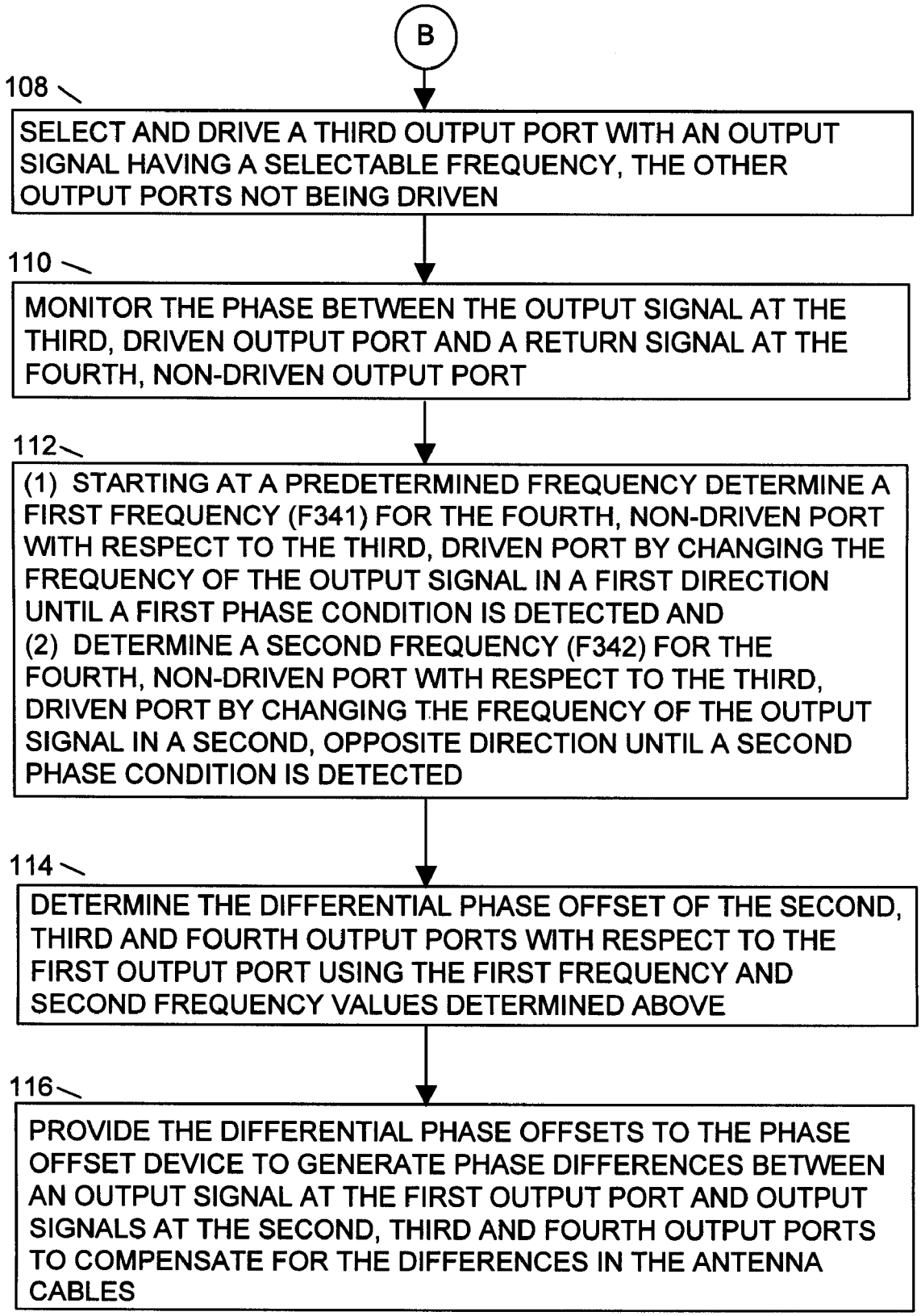

FIGS. 6A-6C are a flow chart illustrating the third process of determining and compensating for phase differences in the antenna cables.

A first system port (e.g., S1) is selected and driven 90 with an output signal having a selectable frequency, the other system ports (e.g., S2, S3, and S4) are not driven. The phase between the output signal at the first, driven system port and a return signal at a second, non-driven system port (e.g., one of S2, S3, or S4) is then monitored 92.

Assume for purposes of the discussion below that S1 is the first port chosen, then S2, then S3, and then finally S4. Starting at a predetermined frequency, a first frequency (i.e., F121) is determined 94 for the second, non-driven port (S2) with respect to the first, driven port (S1) by changing the frequency of the output signal in a first direction until a first phase condition is detected, and a second frequency (i.e., F122) is determined 94 for the second, non-driven port with respect to the first, driven port by changing the frequency of the output signal in a second, opposite direction until a second phase condition is detected. The predetermined frequency can be any frequency appropriate for the communications system in use and, for use with the ISS system, the predetermined frequency is the transmitting frequency: 1090 MHz.

The first phase condition may be any desired phase condition, e.g., zero degrees, 45 degrees, 90 degrees, etc. In one embodiment, the first phase condition is 90 degrees. The reason for this is that the output of the phase detectors are more linear and accurate and provide for better repeatability of results when the phase difference is 90 degrees than when the phase difference is, for example, zero degrees. Similar beneficial results are obtained when the phase difference is 270 degrees (i.e., −90 degrees).

The second phase condition, like the first phase condition, may also be any desired phase condition but, for simplicity of calculation, and accuracy and repeatability of results, the second phase condition is the next 90 degree phase condition that is encountered as the frequency is changed in the opposite direction.

In addition, to reduce or eliminate the effects of minor errors, such as biasing errors in the phase detectors, and to improve the consistency and accuracy of results, the first and second phase conditions also preferably have the same slope with respect to changes in frequency. This slope may either be positive or negative, as desired.

Thus, in one embodiment, the first and second phase conditions are both a 90 degree phase difference with a positive phase/frequency slope.

The frequency may be changed first upwardly and then, second, downwardly, or first downwardly and then, second, upwardly, as desired.

Thus, in one embodiment, the frequency is changed in an upwardly direction until a 90 degree phase difference, with a positive phase/frequency slope, is detected between the transmitted signal and the return signal, and this frequency is F121, and then the frequency is changed in a downwardly direction until the next 90 degree phase difference, again with a positive phase/frequency slope, is detected, and this frequency is F122.

The process is then repeated to determine the frequencies of interest for the next port (S3) with respect to the first port (S1). Therefore, a first frequency (i.e., F131) for the third, non-driven port (S3) with respect to the first, driven port (S1), and a second frequency (i.e., F132) for the third, non-driven port with respect to the first, driven port, are determined 96 by performing 94(1) and 94(2) for the first, driven system port (S1) and a third, non-driven system port (S3).

Similarly, the process is then repeated to determine the frequencies of interest for the next port (S4) with respect to the first port (S1). Therefore, a first frequency (i.e., F141) for the fourth, non-driven port (S4) with respect to the first, driven port (S1) and a second frequency (i.e., F142) for the fourth, non-driven port with respect to the first, driven port are determined 98 by performing 94(1) and 94(2) for the first, driven system port (S1) and the fourth, non-driven system port (S4).

The process is then repeated, but with the second port (S2) being driven, and the other ports (S1, S3, S4) not being driven, in order to determine the first and second frequencies for ports S3 and S4 with respect to port S2.

The second system port (S2) is selected and driven 100 with an output signal having a selectable frequency, the other system ports (S1, S3 and S4) not being driven. The phase between the output signal at the second, driven system port (S2) and a return signal at the third, non-driven system port (S3) is then monitored 102.

Starting at a predetermined frequency, a first frequency (i.e., F231) for the third, non-driven port with respect to the second, driven port, and a second frequency (i.e., F232) for the third, non-driven port with respect to the second, driven port are determined 104 by performing 94(1) and 94(2) for the second, driven system port (S2) and the third, non-driven system port (S3).

The process is then repeated to determine the frequencies of interest for the next port (S4) with respect to the second port (S2). Therefore, a first frequency (i.e., F241) for the fourth, non-driven port (S4) with respect to the second, driven port (S2), and a second frequency (i.e., F242) for the fourth, non-driven port with respect to the second, driven port, are determined 106 by performing 104(1) and 104(2) for the second, driven system port (S2) and the fourth, non-driven system port (S4).

The process is then repeated, but with the third port (S3) being driven, and the other ports (S1, S2, S4) not being driven, in order to determine the first and second frequencies for port S4 with respect to port S3.

The third system port (S3) is selected and driven 108 with an output signal having a selectable frequency, the other system ports (S1, S2 and S4) not being driven. The phase between the output signal at the third, driven system port (S3) and a return signal at the fourth, non-driven system port (S4) is then monitored 110.

Starting at a predetermined frequency, a first frequency (i.e., F341) for the fourth, non-driven port with respect to the third, driven port, and a second frequency (i.e., F342) for the fourth, non-driven port with respect to the third, driven port are determined 112 by performing 94(1) and 94(2) for the third, driven system port (S3) and the fourth, non-driven system port (S4).

The differential phase offsets needed to compensate for the differences in the antenna cables (C) between the system ports S and the respective antenna ports A are then determined 114 using these determined frequencies (F121, F122, F131, F132, F141, F142, F231, F232, F241, F242, F341 and F342).

These differential phase offsets are then provided 116 to the phase offset device to generate the appropriate phase differences to compensate for the differences in the antenna cables (C) between the system ports S and the respective antenna ports A.

The Minimum Operational Performance Standards (MOPS) for Mode S transmissions is 1 MHz around the center frequency if 1090 MHz. Therefore, a frequency shift of up to 2 MHz can be used at full power during normal Mode S transmissions, for cable calibration purposes, without the MOPS. For greater frequency shifts, reduced power transmissions should be used for cable calibration purposes to keep RF emissions below the MOPS and FCC requirements.

A Method of Determining the Differential Lengths of the Antenna Cables.

The differential phase shift in radians DPCRXY between two cables is a function of the differential physical cable length (DLXY) between the cables, and the change in wavelength (DLAMBDA), which is a function of the cable propagation velocity (V) and the change in frequency (F2–F1). That is:

$$DPCRXY=DLXY/DLAMBDA*2PI,$$

but $DLAMBDA=V/(F2-F1)$, so $$DPCRXY=DLXY*2PI/(V/(F2-F1))$$

$$DPCRXY=DLXY*2PI(F2-F1)/V.$$

Applying 2PI radians=360 degrees yields:

$DPCXY=DLXY*360*(F2-F1)/V$, where $DPCXY$ is in degrees.

Solving for DLXY and rearranging terms yields:

$$DLXY=(V/(F2-F1))*(DPCXY/360).$$

Therefore, the differential physical length (DL21) of cable C2 with respect to cable C1 is:

$$DL21=(V/(F2-F1))*(DPC21/360).$$

Similarly, the differential physical length DL31, DL41 of cables C3 and C4, respectively, is:

$$DL31=(V/(F2-F1))*(DPC31/360), \text{ and}$$

$$DL41=(V/(F2-F1))*(DPC41/360).$$

Therefore, if desired, the differences in the physical lengths of the various cables C with respect to a common cable CX can also be determined.

Creating an Omnidirectional Pattern.

Now that the phase errors due to the ISS components and the cables have been determined, this information can be used to provide phase offsets, or phase biases, to the phase offset device 14. When the system is to transmit in Mode-S, the compensating offsets should be applied in order to achieve the desired omnidirectional pattern. When the system is to transmit in the TCAS mode, however, only one TCAS port at a time will be energized, so any phase offset applied to that port is of no significance. As a result, these compensating offsets can be permanently applied and used at all times in both Mode-S and the TCAS mode.

These calibration methods can be performed while the ISS system is not in use, such as when the aircraft is sitting at the hanger and, further, these calibration methods can be performed while the ISS system is in actual use. For example, the methods for determining the phase errors due to the antenna cables can be performed whenever the TCAS transmitter is transmitting in normal operation, and the method for determining the phase errors due to the ISS system components can be performed whenever there is a Mode-S transmission.

Also, these calibration methods can be applied at any time, even while the aircraft is moving, and can be applied upon demand and/or automatically upon the occurrence of predetermined events, such as, for example, power-up of the ISS system, when the temperature has changed more than a certain amount since the last calibration, every X hours, every X transmissions, every X flights or sorties, etc. Transmissions can be in response to interrogatories, or can be "null" transmissions. It should be noted, however, that the regulations regarding TCAS and Mode-S transmissions may limit the frequencies that can be used and/or the number of null transmissions. Therefore, in a practical setting, the regulations regarding the permitted transmissions and/or frequencies may determine which one of the methods described above may be used.

It is also contemplated that reduced power transmissions may be used for phase calibration purposes such that, if desired, any of the above phase calibration methods may be used. If, however, there are non-linearities such that the relative transmitter phase shifts of each channel at reduced power output are not equal to the relative transmitter phase shifts at full power, then the phase calibration must be performed at full power. Otherwise, the differential phase shifts computed by the phase calibration algorithm at reduced power will not be the correct ones to use when operating at full power. Such non-linearities, if present, may be due to, but are not necessarily due to or limited to, the transmitters TX1-TX4.

Therefore, the above methods provide for accurately determining and compensating for the phase errors due to the ISS system components and the antenna cables so that the directional TCAS antenna can also be used for Mode-S operations.

In addition, now that these phase errors have been determined and compensated for, different antenna patterns can be obtained by looking up the "textbook" phase shifts required for a desired pattern, these textbook phase shifts being adjusted by the phase offsets determined above.

Although it is preferable that both ISS phase errors and antenna cable phase errors be determined and compensated for, correcting phase errors from only one source will still be beneficial. If, however, only one source of phase error is to be corrected, such as due to processor and/or memory limitations, then the cable phase errors are preferably corrected as these are typically the most unpredictable and significant phase errors.

An S-Port Board Implementation.

FIG. 7 is a diagram of the design and layout of an exemplary S-port circuit board implementation. All other things being equal, if two paths have the same length, they will have the same phase delay. Therefore, for greatest accuracy, the paths and connections between the S-ports, the attenuators, and the phase detectors should be as consistent, uniform, and symmetrical as possible. The circuit board layout shown provides the desired uniformity and symmetry. The circuit board B has the four ports S1, S2, S3, S4 uniformly placed inside the vertices of a square. The phase detectors (PD) are preferably spaced midway between the ports to which they are connected. For the phase detectors in the horizontal and vertical orientations (as viewed on the drawing) this is straightforward. For the phase detectors in the diagonal orientations, however, in order to have both of them spaced midway between the ports to which they are connected, and to have them as closely matched as possible, one phase detector is placed on one side of the board, and the other phase detector is placed on the other side of the board. This helps to avoid non-symmetries due to, for example, different path lengths, unbalanced path lengths, plated-through holes on one phase detector circuit but not on another, etc.

Also, preferably, as shown, every attenuator ATTN is spaced the same distance from the port to which it is connected. Preferably, as shown, the attenuators in the horizontal and vertical orientations (as viewed on the drawing) will all be spaced the same distance from the input of their respective phase detectors (PD). Likewise, preferably, and as shown, the attenuators in the diagonal orientations will all be spaced the same distance from the input of their respective phase detectors (PD). The outputs (P12, P13, etc.) of the phase detectors are also shown but are generally not critical as long as their placement does not substantially disturb the phase symmetry for the various ports, attenuators, and phase detectors.

In one alternative embodiment (not shown), the symmetrical board B is not used. In this alternative embodiment the phase symmetry (or non-symmetry) characteristics of the board are independently measured, such as in the factory or prior to installation in the equipment, or for different characteristics of the phase detectors. These characteristics are then provided to the processor in the ISS unit so as to compensate for errors in phase measurements due to the non-symmetrical layout of the board. For example, if it is found that the phase measurement P13 is 1 degree high, then the processor can be programmed to reduce the phase measurement P13 by 1 degree before using that phase measurement to determine the compensating phase offsets to be applied to the phase offset device 14.

In another alternative embodiment, the symmetrical board B is used, but the phase symmetry (or non-symmetry) characteristics of the board are independently measured, such as in the factory or prior to installation in the equipment. These characteristics are then provided to the processor in the ISS unit so as to compensate for errors in phase measurements due to differences in the characteristics of the phase detectors.

Another Exemplary Implementation.

FIG. 8 is a block diagram of another exemplary implementation of an ISS system 10. The transmit signals are generated in the transmitter direct digital synthesizers DDS1-DDS4, amplified in the transmitters TX1-TX4, respectively, passed through the transmit/receive switches T/R1-T/R4, respectively, and applied to the ISS 10 antenna connectors, that is, the S-ports S1, S2, S3 and S4, respectively.

The differential phase shift due to the four antenna cables C1-C4 (FIGS. 1 and 2) that connect the ISS Unit 10 to the Antenna Unit 16 is preferably determined in a manner that avoids having to separately calibrate the phase for the transmitters and for the receivers, so as to allow the phase error measurements determined for calibrating the transmitter to also be used for calibrating the receiver. This can be accomplished if phase measurements are made at points that are common to both the transmitter and the receiver. These phase measurement common points (CP1, CP2, CP3, CP4) can be anywhere between the T/R switch output and the S-port for each cable. In one embodiment the common points CP are the S-ports; in another embodiment the common points CP are between the transmit/receive switches and the S-ports. In the latter case, as there may be phase differences due to the different physical paths and circuits between the common points CP and the S-ports, the measurement methods described above should be understood as being taken at the common points CP rather than at the S-ports; the method for determining the phase errors due to the ISS device then yielding phase measurements for the ISS system up to the common points CP, and the method for determining phase errors due to the antenna cables then yielding phase measurements for the ISS system from the common points CP, through the S-ports, and through and including the cables C.

In one embodiment, rather than using a plurality of phase detectors and attenuators on an S-port board B, a Phase Measurement Input Circuit (PMIC) is used to multiplex the signals from the common points CP to provide a multiplexed signal to a common receiver, where the channel-to-channel differential phase shifts between the common points CP and the common output of the SUMMER are known by design or by independent measurement. In this embodiment the signals are provided to a common receiver (not shown, but indicated by RX), which then makes the phase measurements. As previously mentioned, the measurements are made to determine and compensate for the phase errors in the ISS device, principally due to the differing characteristics of the transmitters TX1-TX4 and the transmit/receive switches T/R1-T/R4, respectively. As also previously mentioned, measurements are made to determine and compensate for the phase errors due to the cables C.

In one embodiment, a SUMMER and switches SW1-SW4 are used to multiplex the signals. The switches may be necessary to provide only the desired signal to the SUMMER to eliminate phase measurement errors due to the antenna port-to-port coupling. For example, if the coupling between diagonal ports is 4 dB, and each cable has a 2 dB loss, the diagonal port signal will only be 8 dB below the signal of the desired port, and may be at any phase. Without the switches this coupling can cause a phase error of up to approximately plus or minus 9 degrees.

Once the required phase offsets have been determined, the phase of the DDS devices DDS2, DDS3 and DDS4 are then varied by these phase offset values. These offset values may also be provided to the receiver circuitry or processor if it is desired to calibrate the receive antenna pattern as well.

The input power and dynamic range of the PMIC is determined by the output power of the transmitter and the relative port-to-port coupling of the antenna. The antenna port-to-port attenuation for an exemplary embodiment has been measured and varies from approximately 4 dB for the diagonal ports to approximately 18 dB for the adjacent ports. Therefore, the PMIC dynamic range is preferably at least 14 dB.

Each degree of differential phase uncertainty between the PMIC measurement points CP and the common output point of the SUMMER adds a degree of differential phase error at the antenna ports. The desired differential phase accuracy for phase calibration is 10 degrees so the phase accuracy of the PMIC must be determined in view of the anticipated and uncorrectable phase errors from other sources. From testing of one embodiment it is anticipated that the phase accuracy of the PMIC should therefore be on the order of 3 to 5 degrees, or less; of course, from a measurement viewpoint, better accuracy is preferred but, from a cost viewpoint, less accuracy may be tolerable.

In one embodiment, one of the existing channel receivers is used for calibration purposes when TCAS or Mode-S communications are not in progress. In this embodiment, the output of the PMIC is preferably routed directly to the receiver card. One point to interface with the receiver may be after the low noise amplifier (LNA) in the receiver (not shown) as high sensitivity is not required because the transmitters TX1-TX4 provide adequate signal strength. Also, by placing the phase measurement input point after the UNA, the power to the INA can be switched off during phase measurements to prevent interference from any transmit signals leaking through the T/R switches.

For the PMIC switches, small, low cost surface mount GaAs switches that offer approximately 50 dB isolation at L-band may be used. It is preferable, when selecting such switches, that the phase shift through the switch be as constant as possible over time and temperature.

If maintaining a known differential phase shift through the PMIC is problematic, then the optional calibration circuit OCC may be used. The OCC uses a splitter to inject a 1090 MHz test signal T at the common points CP1-CP4 so that the differential phase shifts between the common points and the output of the SUMMER can be determined and accounted for in the phase error measurements described above. Attenuators may be necessary to prevent signals on other channels from influencing the phase measurement on the measured channel.

A known and constant phase shift through the OCC will be relatively easy to obtain as few elements are required, and none of them need be active elements, like amplifiers or switches. If the OCC circuit is used to calibrate the PMIC, then the phase shift of the PMIC can be arbitrary.

Process descriptions, steps, or blocks in the flow or data flow diagrams described herein and/or depicted in the attached figures should be understood as potentially representing modules, segments, or portions of code which include one or more executable instructions for implementing specific logical functions or steps in the process. Alternate implementations are included within the scope of the preferred embodiments of the systems and methods described herein in which steps or functions may be deleted, executed out of order from that shown or discussed, executed concurrently, substantially concurrently, or sequentially, or even in reverse order, depending on the functionality involved.

Conditional language, such as, among others, "can", "could", "might", or "may", unless specifically stated otherwise, or otherwise understood within the context as used, is generally intended to convey that certain embodiments optionally could include, while some other embodiments do not include, certain features, elements and/or steps. Thus, such conditional language indicates, in general, that those features, elements and/or step are not required for every implementation or embodiment.

Various valuable aspects, benefits, capabilities, embodiments and/or features have been described above which are not available in the prior art. Further, these various aspects, benefits, capabilities, embodiments and/or features may be used independently or in combination, as appropriate to achieve a desired result; it is not necessary to incorporate every aspect, benefit, capability, embodiment and/or feature into a single implementation in order to obtain specific desired aspects, benefits, capabilities, and/or features.

Other variations of these aspects, benefits, capabilities, embodiments and/or features will suggest themselves to those of skill in the field upon examination of the drawings and detailed description and all such variations are included within the scope of the present invention, as defined by the accompanying claims. Therefore, the scope of the present invention is to be defined by the claims.

I claim:

1. For use with a system having an antenna array having a plurality of antennas in a symmetrical arrangement about an axis, a plurality of system ports connected to the plurality of antennas by a corresponding plurality of antenna cables, and a corresponding plurality of transmitters to provide output signals to the plurality of system ports, a method for determining phase offsets necessary to compensate for differences in the antenna cables, the method comprising:

causing each transmitter of predetermined ones of the plurality of transmitters to drive its corresponding system port with an output signal, the other system ports not being driven;

measuring the phase differences between the output signal at the predetermined, driven system port and return signals at predetermined, non-driven system ports; and determining differential phase offsets to compensate for the differences in antenna cables based upon the measured phase differences.

2. The method of claim 1 wherein causing each transmitter of predetermined ones of the plurality of transmitters to drive its corresponding system port with an output signal comprises:

(A) selecting and driving a first system port with an output signal, the second, third and fourth system ports not being driven;

(B) selecting and driving the second system port with an output signal having a selectable frequency, the other system ports not being driven; and (C) selecting and driving the third system port with an output signal having a selectable frequency, the other system ports not being driven.

3. The method of claim 2 wherein measuring the phase differences comprises:

After (A), measuring the phase differences between the output signal at the first, driven system port and return signals at the non-driven system ports;

After (B), measuring the phase differences between the output signal at the second, driven system port and return signals at the third and fourth non-driven system port; and After (C), measuring the phase difference between the output signal at the third, driven system port and a return signal at the fourth, non-driven system port.

4. The method of claim 1 and further comprising providing the differential phase offsets to the phase offset device to generate phase differences between an output signal at the first system port and output signals at the second, third and fourth system ports to compensate for the differences in the antenna cables between the system ports and the respective antenna ports.

5. The method of claim 1 wherein the differential phase offsets of the second, third and fourth system ports with respect to the first system port are determined as:

$$DPC12=(P24-P13+P23-P14)/2,$$

$$DPC13=(P34-P12+P23-P14)/2, \text{ and}$$

$$DPC14=(P34-P12+P24-P13)/2,$$

where P12, P13, P14, P23, P24, and P34 are the measured phase differences between the output signal at the driven system port and the return signals at the non-driven system ports.

6. The method of claim 1 wherein the differential phase offsets of the second, third and fourth system ports with respect to the first system port are determined as:

determining the differential phase shifts between symmetrical pairs of antenna ports; and using the differential phase shifts between symmetrical pairs to determine the differential phase offsets.

7. The method of claim 6 wherein the differential phase shifts between symmetrical pairs of antenna ports are determined as:

$$P2314=P23-P14,$$

$$P2413=P24-P13, \text{ and}$$

$$P3412=P34-P12,$$

where P12, P13, P14, P23, P24, and P34 are the measured phase differences between the output signal at the driven system port and the return signals at the non-driven system ports.

8. The method of claim 7 wherein the differential phase offsets are determined as:

$$DPC12=(P2413+P2314)/2,$$

$$DPC13=(P3412+P2314)/2, \text{ and}$$

$$DPC14=(P3412+P2413)/2.$$

* * * * *

UNITED STATES PATENT AND TRADEMARK OFFICE

CERTIFICATE OF CORRECTION

PATENT NO. : 7,482,976 B2
APPLICATION NO. : 11/697757
DATED : January 27, 2009
INVENTOR(S) : Gregory H. Piesinger It is certified that error appears in the above-identified patent and that said Letters Patent is hereby corrected as shown below:

On the Title Page, Item (75) should read
Inventor: Gregory H. Piesinger, Cave Creek, AZ (US)

Signed and Sealed this

Seventh Day of April, 2009

JOHN DOLL
*Acting Director of the United States Patent and Trademark Office*